US008976207B2

(12) United States Patent
Umezaki et al.

(10) Patent No.: US 8,976,207 B2
(45) Date of Patent: Mar. 10, 2015

(54) LIQUID CRYSTAL DISPLAY DEVICE AND ELECTRONIC DEVICE

(71) Applicant: Semiconductor Energy Laboratory Co., Ltd., Atsugi-shi, Kanagawa-ken (JP)

(72) Inventors: Atsushi Umezaki, Isehara (JP); Hiroyuki Miyake, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 13/928,669

(22) Filed: Jun. 27, 2013

(65) Prior Publication Data

US 2013/0286058 A1 Oct. 31, 2013

Related U.S. Application Data

(63) Continuation of application No. 13/027,491, filed on Feb. 15, 2011, now Pat. No. 8,477,158.

(30) Foreign Application Priority Data

Feb. 19, 2010 (JP) ..... 2010-034884

(51) Int. Cl.
*G09G 5/10* (2006.01)
*G09G 3/36* (2006.01)

(52) U.S. Cl.
CPC ..... *G09G 3/3607* (2013.01); *G09G 3/3648* (2013.01); *G09G 2320/103* (2013.01)
USPC ..... 345/690; 345/89; 345/94; 345/102; 345/691

(58) Field of Classification Search
USPC ..... 345/89, 94, 102, 690, 691
See application file for complete search history.

(56) References Cited

U.S. PATENT DOCUMENTS 5,349,366 A 9/1994 Yamazaki et al.
5,731,856 A 3/1998 Kim et al.

(Continued)

FOREIGN PATENT DOCUMENTS

EP 1182638 A 2/2002
EP 1443486 A 8/2004

(Continued)

OTHER PUBLICATIONS

Tsuda et al., "Ultra Low Power Consumption Technologies for Mobile TFT-LCDs," IDW '02: Proceedings of the 9th International Display Workshops, Dec. 4, 2002, pp. 295-298.

(Continued)

*Primary Examiner* — Premal Patel
(74) *Attorney, Agent, or Firm* — Eric J. Robinson; Robinson Intellectual Property Law Office, P.C.

(57) ABSTRACT

To suppress deterioration of quality of a still image displayed with a reduced refresh rate. A liquid crystal display device includes a display portion that is controlled by a driver circuit and includes normally white mode (or normally black mode) liquid crystals, and a timing controller for controlling the driver circuit. The timing controller is supplied with an image signal for displaying a moving image and an image signal for displaying a still image. The absolute value of a voltage applied to the liquid crystals in order to express black (or white) in an image corresponding to the image signal for displaying the still image is larger than that of a voltage applied to the liquid crystals in order to express black (or white) in an image corresponding to the image signal for displaying the moving image.

14 Claims, 16 Drawing Sheets

(56) References Cited

U.S. PATENT DOCUMENTS

| | | | |
|---|---|---|---|
| 5,744,864 | A | 4/1998 | Cillessen et al. |
| 6,072,454 | A | 6/2000 | Nakai et al. |
| 6,294,274 | B1 | 9/2001 | Kawazoe et al. |
| 6,563,174 | B2 | 5/2003 | Kawasaki et al. |
| 6,727,522 | B1 | 4/2004 | Kawasaki et al. |
| 6,806,860 | B2 | 10/2004 | Saito et al. |
| 6,956,553 | B2 | 10/2005 | Tsutsui et al. |
| 7,049,190 | B2 | 5/2006 | Takeda et al. |
| 7,061,014 | B2 | 6/2006 | Hosono et al. |
| 7,064,346 | B2 | 6/2006 | Kawasaki et al. |
| 7,079,102 | B2 | 7/2006 | Miyachi |
| 7,105,868 | B2 | 9/2006 | Nause et al. |
| 7,211,825 | B2 | 5/2007 | Shih et al |
| 7,224,339 | B2 | 5/2007 | Koyama et al. |
| 7,282,782 | B2 | 10/2007 | Hoffman et al. |
| 7,297,977 | B2 | 11/2007 | Hoffman et al. |
| 7,323,356 | B2 | 1/2008 | Hosono et al. |
| 7,358,951 | B2 | 4/2008 | Saito et al. |
| 7,379,058 | B2 | 5/2008 | Toyozawa et al. |
| 7,385,224 | B2 | 6/2008 | Ishii et al. |
| 7,397,457 | B2 | 7/2008 | Sugino et al. |
| 7,402,506 | B2 | 7/2008 | Levy et al. |
| 7,411,209 | B2 | 8/2008 | Endo et al. |
| 7,453,065 | B2 | 11/2008 | Saito et al. |
| 7,453,087 | B2 | 11/2008 | Iwasaki |
| 7,462,862 | B2 | 12/2008 | Hoffman et al. |
| 7,468,304 | B2 | 12/2008 | Kaji et al. |
| 7,501,293 | B2 | 3/2009 | Ito et al. |
| 7,592,995 | B2 | 9/2009 | Sugino et al. |
| 7,674,650 | B2 | 3/2010 | Akimoto et al. |
| 7,732,819 | B2 | 6/2010 | Akimoto et al. |
| 8,760,376 | B2 | 6/2014 | Koyama et al. |
| 2001/0046027 | A1 | 11/2001 | Tai et al. |
| 2002/0056838 | A1 | 5/2002 | Ogawa |
| 2002/0132454 | A1 | 9/2002 | Ohtsu et al. |
| 2003/0179172 | A1 | 9/2003 | Miyachi |
| 2003/0189401 | A1 | 10/2003 | Kido et al. |
| 2003/0218222 | A1 | 11/2003 | Wager et al. |
| 2004/0038446 | A1 | 2/2004 | Takeda et al. |
| 2004/0127038 | A1 | 7/2004 | Carcia et al. |
| 2005/0017302 | A1 | 1/2005 | Hoffman |
| 2005/0199959 | A1 | 9/2005 | Chiang et al. |
| 2006/0035452 | A1 | 2/2006 | Carcia et al. |
| 2006/0043377 | A1 | 3/2006 | Hoffman et al. |
| 2006/0091793 | A1 | 5/2006 | Baude et al. |
| 2006/0108529 | A1 | 5/2006 | Saito et al. |
| 2006/0108636 | A1 | 5/2006 | Sano et al. |
| 2006/0110867 | A1 | 5/2006 | Yabuta et al. |
| 2006/0113536 | A1 | 6/2006 | Kumomi et al. |
| 2006/0113539 | A1 | 6/2006 | Sano et al. |
| 2006/0113549 | A1 | 6/2006 | Den et al. |
| 2006/0113565 | A1 | 6/2006 | Abe et al. |
| 2006/0169973 | A1 | 8/2006 | Isa et al. |
| 2006/0170111 | A1 | 8/2006 | Isa et al. |
| 2006/0197092 | A1 | 9/2006 | Hoffman et al. |
| 2006/0208977 | A1 | 9/2006 | Kimura |
| 2006/0228974 | A1 | 10/2006 | Thelss et al. |
| 2006/0231882 | A1 | 10/2006 | Kim et al. |
| 2006/0238135 | A1 | 10/2006 | Kimura |
| 2006/0244107 | A1 | 11/2006 | Sugihara et al. |
| 2006/0284171 | A1 | 12/2006 | Levy et al. |
| 2006/0284172 | A1 | 12/2006 | Ishii |
| 2006/0292777 | A1 | 12/2006 | Dunbar |
| 2007/0024187 | A1 | 2/2007 | Shin et al. |
| 2007/0046191 | A1 | 3/2007 | Saito |
| 2007/0052025 | A1 | 3/2007 | Yabuta |
| 2007/0054507 | A1 | 3/2007 | Kaji et al. |
| 2007/0090365 | A1 | 4/2007 | Hayashi et al. |
| 2007/0108446 | A1 | 5/2007 | Akimoto |
| 2007/0152217 | A1 | 7/2007 | Lai et al. |
| 2007/0172591 | A1 | 7/2007 | Seo et al. |
| 2007/0187678 | A1 | 8/2007 | Hirao et al. |
| 2007/0187760 | A1 | 8/2007 | Furuta et al. |
| 2007/0194379 | A1 | 8/2007 | Hosono et al. |
| 2007/0216623 | A1 | 9/2007 | Kimura |
| 2007/0252928 | A1 | 11/2007 | Ito et al. |
| 2007/0272922 | A1 | 11/2007 | Kim et al. |
| 2007/0287296 | A1 | 12/2007 | Chang |
| 2008/0006877 | A1 | 1/2008 | Mardilovich et al. |
| 2008/0038882 | A1 | 2/2008 | Takechi et al. |
| 2008/0038929 | A1 | 2/2008 | Chang |
| 2008/0050595 | A1 | 2/2008 | Nakagawara et al. |
| 2008/0073653 | A1 | 3/2008 | Iwasaki |
| 2008/0083950 | A1 | 4/2008 | Pan et al. |
| 2008/0106191 | A1 | 5/2008 | Kawase |
| 2008/0117237 | A1 | 5/2008 | Saito et al. |
| 2008/0128689 | A1 | 6/2008 | Lee et al. |
| 2008/0129195 | A1 | 6/2008 | Ishizaki et al. |
| 2008/0158234 | A1* | 7/2008 | Kim ..... 345/501 |
| 2008/0166834 | A1 | 7/2008 | Kim et al. |
| 2008/0182358 | A1 | 7/2008 | Cowdery-Corvan et al. |
| 2008/0224133 | A1 | 9/2008 | Park et al. |
| 2008/0254569 | A1 | 10/2008 | Hoffman et al. |
| 2008/0258139 | A1 | 10/2008 | Ito et al. |
| 2008/0258140 | A1 | 10/2008 | Lee et al. |
| 2008/0258141 | A1 | 10/2008 | Park et al. |
| 2008/0258143 | A1 | 10/2008 | Kim et al. |
| 2008/0296568 | A1 | 12/2008 | Ryu et al. |
| 2008/0308792 | A1* | 12/2008 | Takahashi ..... 257/40 |
| 2009/0068773 | A1 | 3/2009 | Lai et al. |
| 2009/0073325 | A1 | 3/2009 | Kuwabara et al. |
| 2009/0114910 | A1 | 5/2009 | Chang |
| 2009/0134399 | A1 | 5/2009 | Sakakura et al. |
| 2009/0135123 | A1* | 5/2009 | Yamato et al. ..... 345/94 |
| 2009/0152506 | A1 | 6/2009 | Umeda et al. |
| 2009/0152541 | A1 | 6/2009 | Maekawa et al. |
| 2009/0278122 | A1 | 11/2009 | Hosono et al. |
| 2009/0280600 | A1 | 11/2009 | Hosono et al. |
| 2010/0065844 | A1 | 3/2010 | Tokunaga |
| 2010/0092800 | A1 | 4/2010 | Itagaki et al. |
| 2010/0109002 | A1 | 5/2010 | Itagaki et al. |

FOREIGN PATENT DOCUMENTS

| | | | |
|---|---|---|---|
| EP | 1443487 | A | 8/2004 |
| EP | 1 737 044 | A | 12/2006 |
| EP | 2 226 847 | A | 9/2010 |
| JP | 60-198861 | | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-235995 | A | 9/1988 |
| JP | 63-239117 | A | 10/1988 |
| JP | 63-265818 | A | 11/1988 |
| JP | 05-251705 | A | 9/1993 |
| JP | 08-264794 | | 10/1996 |
| JP | 11-505377 | | 5/1999 |
| JP | 2000-044236 | | 2/2000 |
| JP | 2000-150900 | | 5/2000 |
| JP | 2002-076356 | A | 3/2002 |
| JP | 2002-108301 | A | 4/2002 |
| JP | 2002-289859 | A | 10/2002 |
| JP | 2003-086000 | A | 3/2003 |
| JP | 2003-086808 | A | 3/2003 |
| JP | 2003-207762 | A | 7/2003 |
| JP | 2003-279929 | | 10/2003 |
| JP | 2004-103957 | | 4/2004 |
| JP | 2004-226787 | A | 8/2004 |
| JP | 2004-273614 | A | 9/2004 |
| JP | 2004-273732 | A | 9/2004 |
| JP | 2005-250034 | A | 9/2005 |
| JP | 2006-323092 | | 11/2006 |
| JP | 2007-249215 | A | 9/2007 |
| JP | 2009-229922 | A | 10/2009 |
| WO | WO 2004/114391 | | 12/2004 |
| WO | WO 2006/112110 | | 10/2006 |

OTHER PUBLICATIONS

International Search Report (Application No. PCT/JP2011/052465) Dated Mar. 1, 2011.

Written Opinion (Application No. PCT/JP2011/052465) Dated Mar. 1, 2011.

(56) References Cited

OTHER PUBLICATIONS

Fortunato et al., "Wide-Bandgap High-Mobility ZnO Thin-Film Transistors Produced At Room Temperature," Appl. Phys. Lett. (Applied Physics Letters), Sep. 27, 2004, vol. 85, No. 13, pp. 2541-2543.
Dembo et al., "RFCPUS on Glass and Plastic Substrates Fabricated by TFT Transfer Technology," IEDM 05: Technical Digest of International Electron Devices Meeting, Dec. 5, 2005, pp. 1067-1069.
Ikeda et al., "Full-Functional System Liquid Crystal Display Using CG-Silicon Technology," SID Digest '04: SID International Symposium Digest of Technical Papers, 2004, vol. 35, pp. 860-863.
Nomura et al., "Room-Temperature Fabrication of Transparent Flexible Thin-Film Transistors Using Amorphous Oxide Semiconductors," Nature, Nov. 25, 2004, vol. 432, pp. 488-492.
Park et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Takahashi et al., "Theoretical Analysis of IGZO Transparent Amorphous Oxide Semiconductor," IDW '08: Proceedings of the 15$^{th}$ International Display Workshops, Dec. 3, 2008, pp. 1637-1640.
Hayashi et al., "42.1: Invited Paper: Improved Amorphous In-Ga-Zn-O TFTs," SID Digest '08: SID International Symposium Digest of Technical Papers, May 20, 2008, vol. 39, pp. 621-624.
Prins et al., "A Ferroelectric Transparent Thin-Film Transistor," Appl. Phys. Lett. (Applied Physics Letters), Jun. 17, 1996, vol. 68, No. 25, pp. 3650-3652.
Nakamura et al., "The Phase Relations in the $In_2O_3$-$Ga_2ZnO_4$-ZnO System at 1350°C," Journal of Solid State Chemistry, Aug. 1, 1991, vol. 93, No. 2, pp. 298-315.
Kimizuka et al., "Syntheses and Single-Crystal Data of Homologous Compounds, $In_2O_3(ZnO)m$ ($m$ = 3, 4, and 5), $InGaO_3(ZnO)_3$, and $Ga_2O_3(ZnO)m$ ($m$ = 7, 8, 9, and 16) in the $In_2O_3$-$ZnGa_2O_4$-ZnO System," Journal of Solid State Chemistry, Apr. 1, 1995, vol. 116, No. 1, pp. 170-178.
Nomura et al., "Thin-Film Transistor Fabricated in Single-Crystalline Transparent Oxide Semiconductor," Science, May 23, 2003, vol. 300, No. 5623, pp. 1269-1272.
Masuda et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Asakuma et al., "Crystallization and Reduction of Sol-Gel-Derived Zinc Oxide Films by Irradiation with Ultraviolet Lamp," Journal of Sol-Gel Science and Technology, 2003, vol. 26, pp. 181-184.
Osada et al., "15.2: Development of Driver-Integrated Panel using Amorphous In-Ga-Zn-Oxide TFT," SID Digest '09: SID International Symposium Digest of Technical Papers, May 31, 2009, pp. 184-187.
Nomura et al., "Carrier transport in transparent oxide semiconductor with intrinsic structural randomness probed using single-crystalline $InGaO_3(ZnO)_5$ films," Appl. Phys. Lett. (Applied Physics Letters), Sep. 13, 2004, vol. 85, No. 11, pp. 1993-1995.
Li et al., "Modulated Structures of Homologous Compounds $InMO_3(ZnO)m$ ($M$=In,Ga; $m$=Integer) Described by Four-Dimensional Superspace Group,". Journal of Solid State Chemistry, 1998, vol. 139, pp. 347-355.
Son et al., "42.4L: Late-News Paper: 4 Inch QVGA AMOLED Driven by the Threshold Voltage Controlled Amorphous GIZO ($Ga_2O_3$-$In_2O_3$-ZnO) TFT," SID Digest '08: SID International Symposium Digest of Technical Papers, May 20, 2008, vol. 39, pp. 633-636.
Lee et al., "World's Largest (15-inch) XGA AMLCD Panel Using IGZO Oxide TFT," SID Digest '08: SID International Symposium Digest of Technical Papers, May 20, 2008, vol. 39, pp. 625-628.
Nowatari et al., "60.2: Intermediate Connector with Suppressed Voltage Loss for White Tandem OLEDs," SID Digest '09: SID International Symposium Digest of Technical Papers, May 31, 2009, vol. 40, pp. 899-902.
Kanno et al., "White Stacked Electrophosphorecent Organic Light-Emitting Devices Employing $MoO_3$ as a Charge-Generation Layer," Adv. Mater. (Advanced Materials), 2006, vol. 18, No. 3, pp. 339-342.
Van de Walle, "Hydrogen as a Cause of Doping in Zinc Oxide," Phys. Rev. Lett. (Physical Review Letters), Jul. 31, 2000, vol. 85, No. 5, pp. 1012-1015.
Fung et al., "2-D Numerical Simulation of High Performance Amorphous In-Ga-Zn-O TFTs for Flat Panel Displays," AM-FPD '08 Digest of Technical Papers, Jul. 2, 2008, pp. 251-252, The Japan Society of Applied Physics.
Jeong et al., "3.1: Distinguished Paper: 12.1-Inch WXGA AMOLED Display Driven by Indium-Gallium-Zinc Oxide TFTs Array," SID Digest '08: SID International Symposium Digest of Technical Papers, May 20, 2008, vol. 39, No. 1, pp. 1-4.
Park et al., "High performance amorphous oxide thin film transistors with self-aligned top-gate structure," IEDM 09: Technical Digest of International Electron Devices Meeting, Dec. 7, 2009, pp. 191-194.
Kurokawa et al., "UHF RFCPUs on Flexible and Glass Substrates for Secure RFID Systems," Journal of Solid-State Circuits, 2008, vol. 43, No. 1, pp. 292-299.
Ohara et al., "Amorphous In-Ga-Zn-Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Coates et al., "Optical Studies of the Amorphous Liquid-Cholesteric Liquid Crystal Transition: The "Blue Phase"," Physics Letters, Sep. 10, 1973, vol. 45A, No. 2, pp. 115-116.
Cho et al., "21.2: Al and Sn-doped Zinc Indium Oxide Thin Film Transistors For AMOLED Back-Plane," SID Digest '09: SID International Symposium Digest of Technical Papers, May 31, 2009, pp. 280-283.
Lee et al., "15.4: Excellent Performance of Indium-Oxide-Based Thin-Film Transistors by DC Sputtering," SID Digest '09: SID International Symposium Digest of Technical Papers, May 31, 2009, pp. 191-193.
Jin et al., "65.2: Distinguished Paper: World-Largest (6.5") Flexible Full Color Top Emission AMOLED Display on Plastic Film and Its Bending Properties," SID Digest '09: SID International Symposium Digest of Technical Papers, May 31, 2009, pp. 983-985.
Sakata et al., "Development of 4.0-In. AMOLED Display with Driver Circuit Using Amorphous In-Ga-Zn-Oxide TFTs," IDW '09: Proceedings of the 16$^{th}$ International Display Workshops, 2009, pp. 689-692.
Park et al., "Amorphous Indium-Gallium-Zinc Oxide TFTs and their Application for Large Size AMOLED," AM-FPD '08 Digest of Technical Papers, Jul. 2, 2008, pp. 275-278.
Park et al., "Challenge to Future Displays: Transparent AM-OLED Driven by PEALD Grown ZnO TFT," IMID '07 Digest, 2007, pp. 1249-1252.
Godo et al., "Temperature Dependence of Characteristics and Electronic Structure for Amorphous In-Ga-Zn-Oxide TFT," AM-FPD '09 Digest of Technical Papers, Jul. 1, 2009, pp. 41-44.
Osada et al., "Development of Driver-Integrated Panel using Amorphous In-Ga-Zn-Oxide TFT," AM-FPD '09 Digest of Technical Papers, Jul. 1, 2009, pp. 33-36.
Hirao et al., "Novel Top-Gate Zinc Oxide Thin-Film Transistors (ZnO TFTs) for AMLCDs," Journal of the SID, 2007, vol. 15, No. 1, pp. 17-22.
Hosono, "68.3: Invited Paper: Transparent Amorphous Oxide Semiconductors for High Performance TFT," SID Digest '07: SID International Symposium Digest of Technical Papers, 2007, vol. 38, pp. 1830-1833.
Godo et al., "P-9: Numerical Analysis on Temperature Dependence of Characteristics of Amorphous In-Ga-Zn-Oxide TFT," SID Digest '09: SID International Symposium Digest of Technical Papers, May 31, 2009, pp. 1110-1112.
Ohara et al., "21.3: 4.0 In. QVGA AMOLED Display Using In-Ga-Zn-Oxide TFTs with a Novel Passivation Layer," SID Digest '09: SID International Symposium Digest of Technical Papers, May 31, 2009, pp. 284-287.
Miyasaka, "Suftla Flexible Microelectronics on their Way to Business," SID Digest '07: SID International Symposium Digest of Technical Papers, 2007, vol. 38, pp. 1673-1676.

(56) References Cited

OTHER PUBLICATIONS

Chern et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.
Kikuchi et al., "39.1: Invited Paper: Optically Isotropic Nano-Structured Liquid Crystal Composites for Display Applications," SID Digest '09: SID International Symposium Digest of Technical Papers, May 31, 2009, pp. 578-581.
Asaoka et al., "29.1: Polarizer-Free Reflective LCD Combined With Ultra Low-Power Driving Technology," SID Digest '09: SID International Symposium Digest of Technical Papers, May 31, 2009, pp. 395-398.
Lee et al., "Current Status of, Challenges to, and Perspective View of AM-OLED," IDW '06: Proceedings of the 13$^{th}$ International Display Workshops, Dec. 7, 2006, pp. 663-666.
Kikuchi et al., "62.2: Invited Paper: Fast Electro-Optical Switching in Polymer-Stabilized Liquid Crystalline Blue Phases for Display Application," SID Digest '07: SID International Symposium Digest of Technical Papers, 2007, vol. 38, pp. 1737-1740.
Nakamura, "Synthesis of Homologous Compound with New Long-Period Structure," NIRIM Newsletter, Mar. 1, 1995, vol. 150, pp. 1-4.
Kikuchi et al., "Polymer-Stabilized Liquid Crystal Blue Phases," Nature Materials, Sep. 2, 2002, vol. 1, pp. 64-68.
Kimizuka et al., "Spinel, $YbFe_2O_4$, and $Yb_2Fe_3O_7$ Types of Structures for Compounds in the $In_2O_3$ and $Sc_2O_{3-A2}O_3$-BO Systems [A: Fe, Ga, Or Al; B: Mg, Mn, Fe, Ni, Cu, or Zn] at Temperatures Over 1000°C," Journal of Solid State Chemistry, 1985, vol. 60, pp. 382-384.
Kitzerow et al., "Observation of Blue Phases in Chiral Networks," Liquid Crystals, 1993, vol. 14, No. 3, pp. 911-916.
Costello et al., "Electron Microscopy of a Cholesteric Liquid Crystal and its Blue Phase," Phys. Rev. A (Physical Review A), May 1, 1984, vol. 29, No. 5, pp. 2957-2959.
Meiboom et al., "Theory of the Blue Phase of Cholesteric Liquid Crystals," Phys. Rev. Lett. (Physical Review Letters), May 4, 1981, vol. 46, No. 18, pp. 1216-1219.
Park et al., "42.3: Transparent ZnO Thin Film Transistor for the Application of High Aperture Ratio Bottom Emission AM-OLED Display," SID Digest '08: SID International Symposium Digest of Technical Papers, May 20, 2008, vol. 39, pp. 629-632.
Orita et al., "Mechanism of Electrical Conductivity of Transparent InGaZnO4," Phys. Rev. B (Physical Review B), Jan. 15, 2000, vol. 61, No. 3, pp. 1811-1816.
Nomura et al., "Amorphous Oxide Semiconductors for High-Performance Flexible Thin-Film Transistors," Jpn. J. Appl. Phys. (Japanese Journal of Applied Physics), 2006, vol. 45, No. 5B, pp. 4303-4308.
Janotti et al., "Native Point Defects in ZnO," Phys. Rev. B (Physical Review. B), Oct. 4, 2007, vol. 76, No. 16, pp. 165202-1-165202-22.
Park et al., "Electronic Transport Properties of Amorphous Indium-Gallium-Zinc Oxide Semiconductor Upon Exposure to Water," Appl. Phys. Lett. (Applied Physics Letters), 2008, vol. 92, pp. 072104-1-072104-3.
Hsieh et al., "P-29: Modeling of Amorphous Oxide Semiconductor Thin Film Transistors and Subgap Density of States," SID Digest '08: SID International Symposium Digest of Technical Papers, 2008, vol. 39, pp. 1277-1280.
Janotti et al., "Oxygen Vacancies in ZnO," Appl. Phys. Lett. (Applied Physics Letters), 2005, vol. 87, pp. 122102-1-122102-3.
Oba et al., "Defect energetics in ZnO: A hybrid Hartree-Fock density functional study," Phys. Rev. B (Physical Review B), 2008, vol. 77, pp. 245202-1-245202-6.
Orita et al., "Amorphous transparent conductive oxide $InGaO_3(ZnO)_m$ (m<4): a Zn 4s conductor," Philosophical Magazine, 2001, vol. 81, No. 5, pp. 501-515.
Hosono et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Mo et al., "Amorphous Oxide TFT Backplanes for Large Size AMOLED Displays," IDW '08: Proceedings of the 6$^{th}$ International Display Workshops, Dec. 3, 2008, pp. 581-584.
Kim et al., "High-Performance oxide thin film transistors passivated by various gas plasmas," 214$^{th}$ ECS Meeting, 2008, No. 2317, ECS.
Clark et al., "First Principles Methods Using CASETP," Zeitschrift fur Kristallographie, 2005, vol. 220, pp. 567-570.
Lany et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Park et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Oh et al., "Improving the Gate Stability of ZnO Thin-Film Transistors with Aluminum Oxide Dielectric Layers," J. Electrochem. Soc. (Journal of the Electrochemical Society), 2008, vol. 155, No. 12, pp. H1009-H1014.
Ueno et al., "Field-Effect Transistor on $SrTiO_3$ with Sputtered $Al_2O_3$ Gate Insulator," Appl. Phys. Lett. (Applied Physics Letters), Sep. 1, 2003, vol. 83, No. 9, pp. 1755-1757.

* cited by examiner

LIQUID CRYSTAL DISPLAY DEVICE AND ELECTRONIC DEVICE

TECHNICAL FIELD

The present invention relates to a liquid crystal display device, a method for driving a liquid crystal display device, and an electronic device including a liquid crystal display device.

BACKGROUND ART

Liquid crystal display devices are widely used in large display devices such as television sets and small display devices such as mobile phones. Higher value-added devices have been demanded and the development has progressed. In recent years, attention is attracted to the development of low power consumption liquid crystal display devices, in terms of the increase in interest in global environment and improvement in convenience of mobile devices.

Non-Patent Document 1 discloses a structure in which the refresh rate at the time of displaying a moving image and that at the time of displaying a still image are different from each other in order to reduce power consumption of a liquid crystal display device. Moreover, Non-Patent Document 1 discloses a structure in which, in order to prevent flickers from being perceived with change in drain-common voltage due to switching of signals in a break period and a scanning period when a still image is displayed, alternating-current signals with the same phase are applied to a signal line and a common electrode also in a break period so that the drain-common voltage does not change.

REFERENCE

Non-Patent Document 1: Kazuhiko Tsuda, et al., "Ultra low power consumption technologies for mobile TFT-LCDs", IDW'02, pp. 295-298 (2002)

DISCLOSURE OF INVENTION

As in Non-Patent Document 1, lower power consumption can be realized by a reduction in refresh rate at the time of displaying a still image. However, a voltage between a pixel electrode and a common electrode cannot be kept constant in some cases because the potential of the pixel electrode is changed by the off-state current of a pixel transistor and/or leakage current from liquid crystals. As a result, a voltage applied to the liquid crystals is changed, so that a desired gray level cannot be obtained and the quality of a displayed image deteriorates.

Since the gray level is likely to be changed when display with multiple gray levels is performed, the refresh rate needs to be high enough not to change the gray level. Thus, power consumption of a liquid crystal display device cannot be sufficiently reduced by the reduction in refresh rate.

In view of the above, an object of one embodiment of the present invention is to suppress deterioration of image quality due to change in gray level when a still image is displayed with a reduced refresh rate.

One embodiment of the present invention is a liquid crystal display device described as follows. The liquid crystal display device includes a display portion that is controlled by a driver circuit and includes a normally white mode liquid crystal, and a timing controller for controlling the driver circuit. The timing controller is supplied with an image signal for displaying a moving image and an image signal for displaying a still image. The absolute value of a voltage applied to the normally white mode liquid crystal in order to express black in an image corresponding to the image signal for displaying the still image is larger than the absolute value of a voltage applied to the normally white mode liquid crystal in order to express black in an image corresponding to the image signal for displaying the moving image.

One embodiment of the present invention is a liquid crystal display device described as follows. The liquid crystal display device includes a display portion that is controlled by a driver circuit and includes a normally black mode liquid crystal, and a timing controller for controlling the driver circuit. The timing controller is supplied with an image signal for displaying a moving image and an image signal for displaying a still image. The absolute value of a voltage applied to the normally black mode liquid crystal in order to express white in an image corresponding to the image signal for displaying the still image is larger than the absolute value of a voltage applied to the normally black mode liquid crystal in order to express white in an image corresponding to the image signal for displaying the moving image.

One embodiment of the present invention is a liquid crystal display device described as follows. The liquid crystal display device includes a display portion that is controlled by a driver circuit and includes a normally white mode liquid crystal, and a timing controller for controlling the driver circuit. The timing controller is supplied with an image signal for displaying a still image. The absolute value of a voltage applied to the normally white mode liquid crystal in order to express black in an image corresponding to the image signal on the display portion is increased by the timing controller as the gray level number of the image signal is smaller.

One embodiment of the present invention is a liquid crystal display device described as follows. The liquid crystal display device includes a display portion that is controlled by a driver circuit and includes a normally black mode liquid crystal, and a timing controller for controlling the driver circuit. The timing controller is supplied with an image signal for displaying a still image. The absolute value of a voltage applied to the normally black mode liquid crystal in order to express white in an image corresponding to the image signal on the display portion is increased by the timing controller as the gray level number of the image signal is smaller.

One embodiment of the present invention is a liquid crystal display device described as follows. The liquid crystal display device includes a display portion that is controlled by a driver circuit and includes a normally white mode liquid crystal, and a timing controller for controlling the driver circuit. The timing controller is supplied with a first image signal with a first gray level number and a second image signal with a second gray level number for displaying a still image. By the timing controller, the absolute value of a voltage applied to the normally white mode liquid crystal in order to express black in an image corresponding to the first image signal on the display portion is made smaller than the absolute value of a voltage applied to the normally white mode liquid crystal in order to express black in an image corresponding to the second image signal with the second gray level number smaller than the first gray level number.

One embodiment of the present invention is a liquid crystal display device described as follows. The liquid crystal display device includes a display portion that is controlled by a driver circuit and includes a normally black mode liquid crystal, and a timing controller for controlling the driver circuit. The timing controller is supplied with a first image signal with a first gray level number and a second image signal with a second gray level number for displaying a still image. By the timing controller, the absolute value of a voltage applied to the normally black mode liquid crystal in order to express white in an image corresponding to the first image signal on the display portion is made smaller than the absolute value of a voltage applied to the normally black mode liquid crystal in order to express white in an image corresponding to the second image signal with the second gray level number smaller than the first gray level number.

In the liquid crystal display device according to one embodiment of the present invention, the timing controller may be supplied with an image signal for displaying a moving image. The absolute value of a voltage applied to the normally white mode liquid crystal in order to express black in an image corresponding to the image signal for displaying the still image may be larger than the absolute value of a voltage applied to the normally white mode liquid crystal in order to express black in an image corresponding to the image signal for displaying the moving image.

In the liquid crystal display device according to one embodiment of the present invention, the timing controller may be supplied with an image signal for displaying a moving image. The absolute value of a voltage applied to the normally black mode liquid crystal in order to express white in an image corresponding to the image signal for displaying the still image may be larger than the absolute value of a voltage applied to the normally black mode liquid crystal in order to express white in an image corresponding to the image signal for displaying the moving image.

In the liquid crystal display device according to one embodiment of the present invention, the timing controller may include an analysis unit for determining a gray level number of the image signal, a panel controller including a switch for switching the absolute values of the voltages, and an image signal correction control unit for controlling on/off of the switch in accordance with a signal from the analysis unit.

In the liquid crystal display device according to one embodiment of the present invention, pixels in the display portion may each include a transistor for controlling writing of an image signal. A semiconductor layer of the transistor may comprise an oxide semiconductor.

According to one embodiment of the present invention, it is possible to reduce deterioration of image quality due to change in gray level when a still image is displayed with a reduced refresh rate. In addition, power consumption can be reduced by a reduction in refresh rate at the time of displaying a still image.

BEST MODE FOR CARRYING OUT THE INVENTION

Figure 1A:
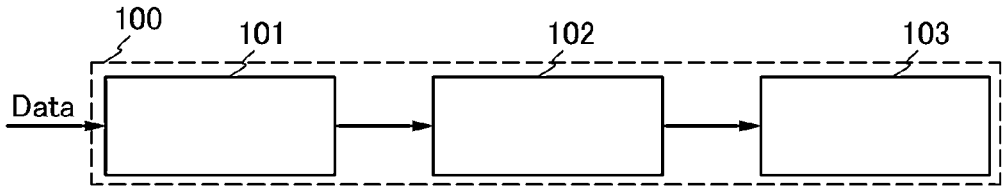
FIGS. 1A to 1C each illustrate a liquid crystal display device according to one embodiment of the present invention.

Embodiments of the present invention will be described below with reference to the accompanying drawings. Note that the present invention can be carried out in many different modes, and it is easily understood by those skilled in the art that modes and details of the present invention can be modified in various ways without departing from the spirit and the scope of the present invention. Therefore, the present invention is not construed as being limited to the following description of the embodiments. Note that in structures of the present invention described below, reference numerals denoting the same portions are used in common in different drawings.

Note that the size of a component, the thickness of a layer, signal waveform, or a region in drawings in embodiments is exaggerated for simplicity in some cases. Therefore, embodiments of the present invention are not limited to such scales.

Note that terms "first", "second", "third" to "Nth" (N is a natural number) employed in this specification are used in order to avoid confusion between components and do not set a limitation on number.

Embodiment 1

In this embodiment, a liquid crystal display device will be described with reference to a schematic diagram, a block diagram, and a diagram showing the relation between the transmittance of a liquid crystal element and an applied voltage.

Figure 1B:
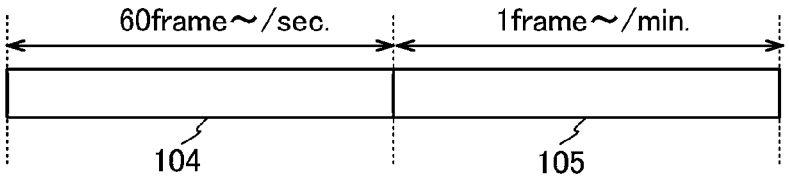
Figure 1C:
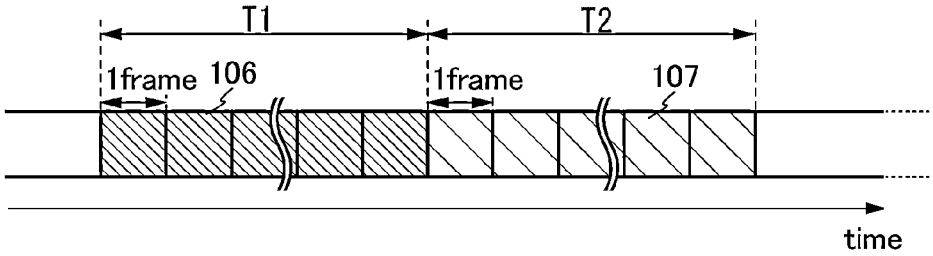

First, a liquid crystal display device according to this specification will be described with reference to FIGS. 1A to 1C illustrating a simple block diagram of the liquid crystal display device and schematic diagrams for explaining the liquid crystal display device.

A liquid crystal display device 100 illustrated in FIG. 1A includes a timing controller (also referred to as a timing control circuit) 101, a driver circuit 102, and a display portion 103. An image signal Data is supplied to the timing controller 101 from the outside.

The timing controller 101 in FIG. 1A has a function of converting the absolute value of a voltage applied to a liquid crystal element in accordance with the number of gray levels of the image signal Data (i.e., the number of gray levels of an image displayed with the image signal Data). Specifically, the timing controller 101 has a function of increasing the absolute value of a voltage applied to a liquid crystal element including normally white mode liquid crystals when black is displayed in an image corresponding to the image signal on the display portion 103, or a function of increasing the absolute value of a voltage applied to a liquid crystal element including normally black mode liquid crystals when white is displayed in an image corresponding to the image signal on the display portion 103.

The driver circuit 102 in FIG. 1A includes a gate line driver circuit (also referred to as a scan line driver circuit) and a source line driver circuit (also referred to as a signal line driver circuit). Each of the gate line driver circuit and the source line driver circuit is a circuit for driving the display portion 103 including a plurality of pixels, and includes a shift register circuit (also referred to as a shift register) or a decoder circuit. Note that the gate line driver circuit and the source line driver circuit may be formed over a substrate where the display portion 103 is formed or a substrate different from the substrate where the display portion 103 is formed.

The display portion 103 in FIG. 1A includes a plurality of pixels, gate lines (also referred to as scan lines) for scanning and selecting the plurality of pixels, and source lines (also referred to as signal lines) for supplying an image signal to the plurality of pixels. The gate lines are controlled by the gate line driver circuit. The source lines are controlled by the source line driver circuit. Each of the pixels includes a transistor as a switching element, a capacitor, and a liquid crystal element. The liquid crystal element has a structure in which liquid crystals are sandwiched between a pixel electrode (a first electrode) and a counter electrode (a second electrode). In this specification, a pixel electrode, a counter electrode, and liquid crystals are collectively referred to as a liquid crystal element.

The liquid crystal display device 100 described in this embodiment has a moving image display period 104 and a still image display period 105 as illustrated in FIG. 1B. Note that in this embodiment, a period for writing an image signal and a retention period in each frame period in the still image display period 105 are specifically described.

Note that in the moving image display period 104, the cycle of one frame period (or the frame frequency) is preferably 1/60 seconds or less (60 Hz or higher). High frame frequency makes it possible for a viewer not to perceive flickers. In the still image display period 105, it is preferable that the cycle of one frame period be extremely extended, for example, to 1 minute or longer (0.017 Hz or lower). By decreasing the frame frequency, eye strain can be reduced as compared to the case where display is switched plural times to display the same image. Note that the frame frequency means a refresh rate and is the number of cycles of display on a screen per second.

Note that it is possible that the moving image display period 104 and the still image display period 105 are switched by supplying a signal for switching from the outside, or that the moving image display period 104 or the still image display period 105 is determined in accordance with the image signal Data. In the case where the moving image display period 104 and the still image display period 105 are switched by judging the image signal Data, the timing controller 101 in FIG. 1A switches a period between a moving image display period during which a moving image is displayed by successive writing of image signals when an image signal written into each pixel in the display portion 103 is different from an image signal written in the previous period; and a still image display period during which writing of an image signal stops and the image signal written into each pixel is maintained so that a still image is displayed, when an image signal written into each pixel in the display portion 103 is the same as that written in the previous period. A reduction in refresh rate corresponds to an increase in length of one frame period.

Next, for explaining the operation of the timing controller 101 in FIG. 1A, a plurality of image signals, here a first image signal and a second image signals, will be described as specific image signals Data with reference to the schematic diagram illustrated in FIG. 1C. FIG. 1C shows that the first image signal is an image signal with the first gray level number (specifically M gray levels, where M is a natural number of 3 or more) and display with the first image signal is performed in a period T1; and the second image signal is an image signal with the second gray level number (specifically N gray levels, where N is a natural number of 2 or more) and display with the second image signal is performed in a period T2. Note that the first gray level number M is larger than the second gray level number N; that is, the first image signals produce an image with a larger number of gray levels than the second image signals. A period 106 serving as one frame period in the period T1 of FIG. 1C is one frame period with the first image signal. A period 107 serving as one frame period in the period T2 of FIG. 1C is one frame period with the second image signal. Note that the following description is made assuming that the first gray level number M is larger than the second gray level number N (M>N).

The refresh rate may vary in the period T1 and the period T2. For example, as the number of gray levels of the image signal is smaller, the refresh rate at the time of displaying an image corresponding to the image signal on the display portion may be decreased. When the refresh rate varies depending on the number of gray levels of the image signal, change in gray level can be reduced even if a voltage applied to a liquid crystal element is changed over time. In particular, in the case where a still image is displayed, it is preferable to drastically reduce the refresh rate when the number of gray levels is small. When the refresh rate is reduced in displaying a still image, the frequency of writing of an image signal can be decreased and power consumption can be reduced. Furthermore, in the case where a still image is displayed by rewriting the same image plural times, eye strain might occur if switching of images is recognized. For that reason, a significant reduction in refresh rate can reduce eye strain.

Note that the number of gray levels (gray level number) refers to the number of sections with which a pixel producing an image expresses gradation of colors, and is represented by the level of a voltage (hereinafter referred to as voltage level) of an image signal written into the pixel. Specifically, the number of gray levels is the total number of voltage levels obtained by dividing the gradient of voltage level into a plurality of levels; the gradient represents change from white to black, expressed by application of voltage to a liquid crystal element including normally white mode liquid crystals. Alternatively, the number of gray levels refers to the number of voltage levels that are actually supplied to pixels producing an image in one frame period, among voltage levels obtained by dividing the gradient of voltage level into a plurality of levels; the gradient represents change from white to black, expressed by application of voltage to a liquid crystal element. Specifically, the number of gray levels is represented by the number of voltage levels supplied to pixels producing an image. Note that a plurality of image signals refer to image signals with different gray level numbers, for example, the above-described first image signal and second image signal.

In this embodiment, the liquid crystal display device has a function of increasing the absolute value of a voltage applied to a liquid crystal element when normally white mode liquid crystals express black in an image corresponding to an image signal or increasing the absolute value of a voltage applied to a liquid crystal element when normally black mode liquid crystals express white in an image corresponding to an image signal, in accordance with the number of gray levels of the image displayed with an image signal particularly in a still image display period. In other words, the absolute voltage of the highest voltage among voltages applied for controlling alignment of liquid crystals is converted in accordance with the number of gray levels of an image.

Note that in the liquid crystal display device of this embodiment, it is preferable that the absolute value of the highest voltage among voltages applied for controlling alignment of liquid crystals be larger in the still image display period 105 than in the moving image display period 104 illustrated in FIG. 1B. For example, for normally white mode liquid crystals, the absolute value of a voltage applied to a liquid crystal element for expressing black in an image corresponding to an image signal in the still image display period 105 is made larger than that in the moving image display period 104. Similarly, for normally black mode liquid crystals, the absolute value of a voltage applied to a liquid crystal element for expressing white in an image corresponding to an image signal in the still image display period 105 is made larger than that in the moving image display period 104. That is, the liquid crystal display device has a structure in which the absolute value of the highest voltage among voltages applied for controlling alignment of liquid crystals is made larger in the still image display period 105 than in the moving image display period 104.

Figure 2A:
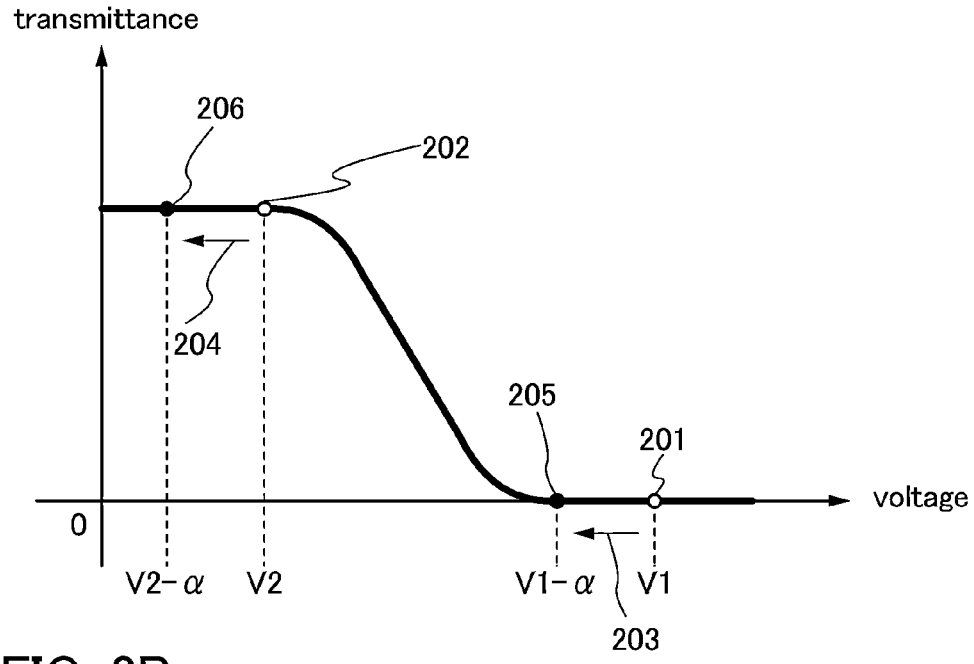
FIGS. 2A and 2B each illustrate a liquid crystal display device according to one embodiment of the present invention.
Figure 2B:
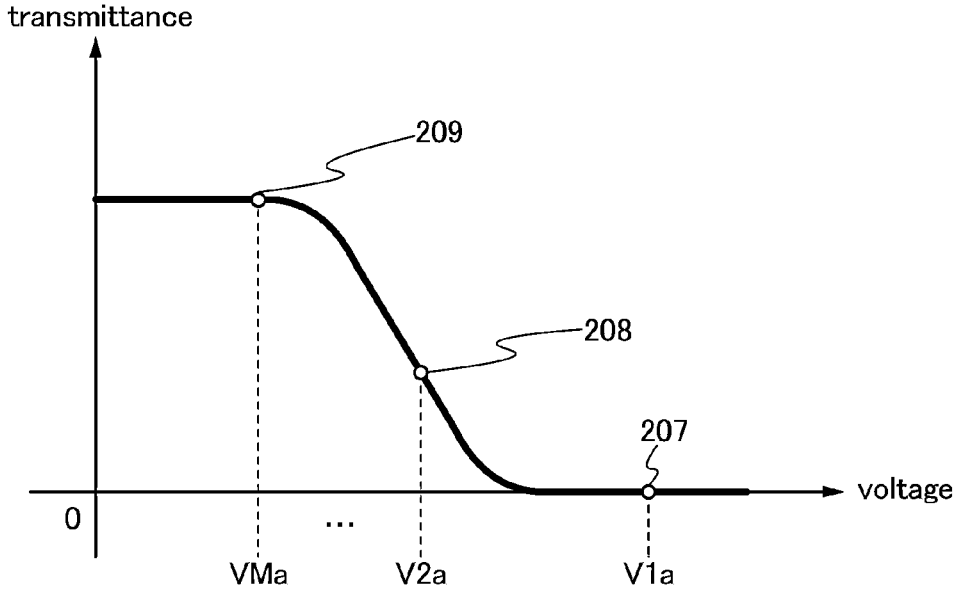

Next, for explaining the effects of the structure in this embodiment, FIG. 2A shows the relation between voltage of an image signal with two gray levels and transmittance of liquid crystals and FIG. 2B shows the relation between voltage of an image signal with M gray levels and transmittance of liquid crystals. Note that FIGS. 2A and 2B show the transmittance of normally white mode liquid crystals, which have high transmittance when 0 V is applied.

In FIG. 2A, of the image signal with two gray levels, a voltage V1 corresponds to a first gray level 201 (black) and a voltage V2 corresponds to a second gray level 202 (white). After the voltage V1 and the voltage V2 are applied in FIG. 2A, the voltages applied to a liquid crystal element are decreased by $\alpha$ ($\alpha$ is a positive number) over time (see an arrow 203 and an arrow 204 in FIG. 2A), so that the gray levels become a gray level 205 corresponding to a voltage V1-$\alpha$ and a gray level 206 corresponding to a voltage V2-$\alpha$. In FIG. 2A, the gray level 205 with the voltage V1-$\alpha$ and the gray level 206 with the voltage V2-$\alpha$ have the same transmittance as the first gray level 201 (black) and the second gray level 202 (white), respectively. In other words, the voltage V1 is preferably converted into a voltage that is increased in advance so that the image quality does not deteriorate because of change in transmittance even if the voltage is decreased over time.

In FIG. 2B, of the image signal with M gray levels, a voltage V1*a* corresponds to a first gray level 207 (black), a voltage V2*a* corresponds to a second gray level 208 (intermediate level), and a voltage VMa corresponds to a Mth gray level 209 (white). As in FIG. 2A, the voltage V1*a* in FIG. 2B is preferably converted into a voltage that is increased in advance so that the image quality does not deteriorate because of change in transmittance even if the voltage is decreased over time. Note that in the example of FIG. 2B, for the second gray level 208 which is an intermediate level, a voltage increased to such a degree that the gray level is not changed with respect to change in voltage may be applied, or it is possible that voltages for intermediate levels are not increased.

As for an image signal with a small number of gray levels, such as the image signal with two gray levels illustrated in FIG. 2A, change in gray level due to reduction in voltage over time is small. For that reason, by application of a large number of increased voltages, change in gray level due to reduction in voltage over time can be reduced, and deterioration of image quality can be reduced. On the other hand, as for an image signal with a large number of gray levels, such as the image signal with M gray levels illustrated in FIG. 2B, change in gray level due to reduction in voltage over time is large. For that reason, it is preferable to reduce deterioration of image quality by increase in refresh rate, rather than by application of a large number of increased voltages. Note that even for an image signal with a large number of gray levels, such as the image signal with M gray levels in FIG. 2B, a voltage expressing the first gray level (black) can be maintained by application of a voltage increased in consideration of change in gray level due to reduction in voltage over time, and the reduction in contrast ratio of images can be suppressed. Note that in order to reduce power consumption, voltage is preferably increased particularly for an image signal with a small number of gray levels, rather than for an image signal with a large number of gray levels.

With the above-described structure in which the absolute value of the highest voltage among voltages applied for controlling alignment of liquid crystals is made larger in the still image display period 105 than in the moving image display period 104, the reduction in contrast ratio of images can be further suppressed. Specifically, for normally white mode liquid crystals, the absolute value of a voltage applied to a liquid crystal element for expressing black in an image corresponding to an image signal in the still image display period 105 is made larger than that in the moving image display period 104. Since the refresh rate in the still image display period 105 is lower than that in the moving image display period 104, change in gray level due to reduction in voltage over time is large. For that reason, by increasing the absolute value of the highest voltage among voltages applied for controlling alignment of liquid crystals in the still image display period 105, the reduction in contrast ratio of images can be suppressed. Note that even if the absolute value of the highest voltage among voltages applied for controlling alignment of liquid crystals is increased in the moving image display period 104, change in gray level due to reduction in voltage over time does not have such an influence that the reduction in contrast ratio of images is suppressed. Therefore, it is rather preferable to decrease the absolute value of the highest voltage among voltages applied for controlling alignment of liquid crystals, because power consumption can be reduced.

Figure 3A:
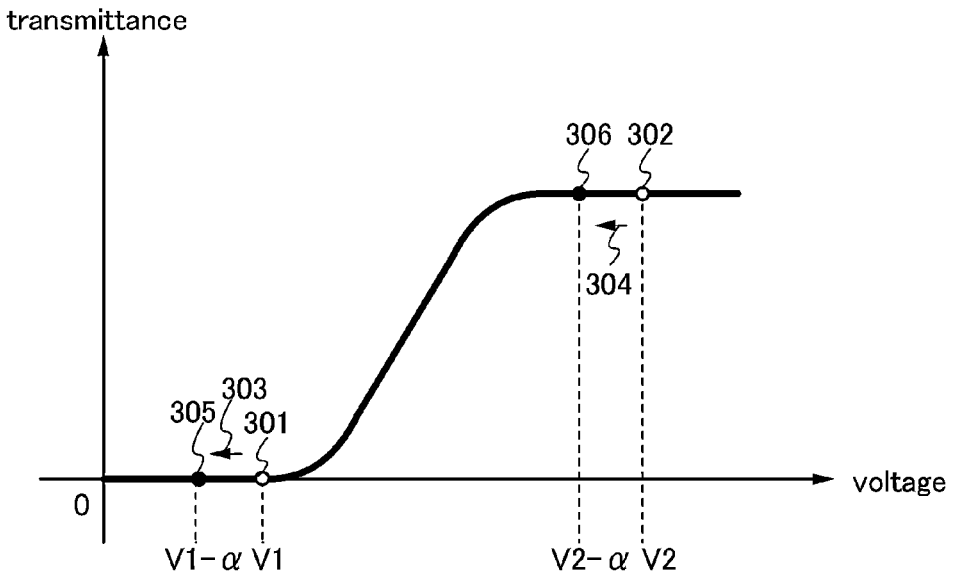
FIGS. 3A and 3B each illustrate a liquid crystal display device according to one embodiment of the present invention.
Figure 3B:
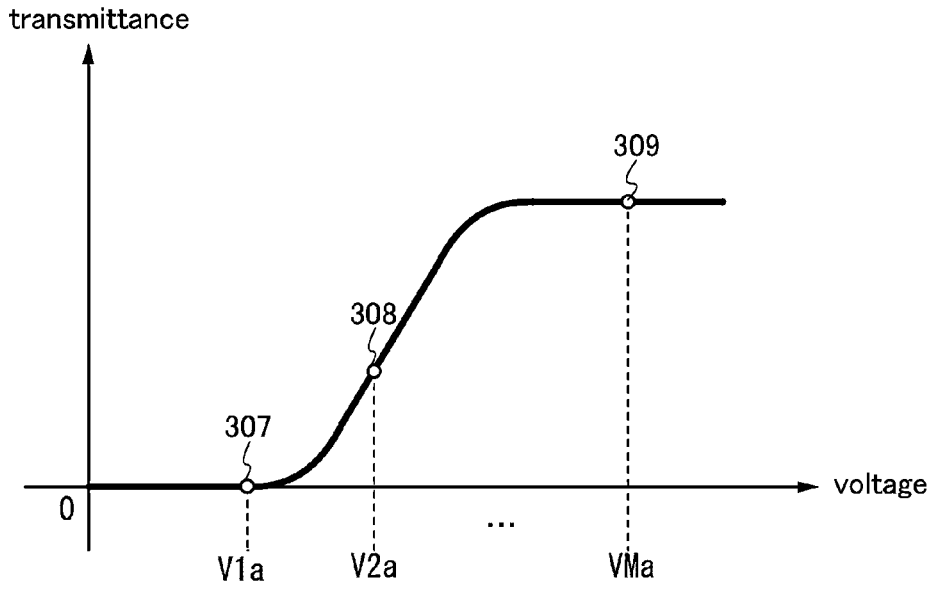

As in FIGS. 2A and 2B, FIG. 3A shows the relation between voltage of an image signal with two gray levels and transmittance of liquid crystals and FIG. 3B shows the relation between voltage of an image signal with M gray levels and transmittance of liquid crystals. Note that FIGS. 3A and 3B show the transmittance of normally black mode liquid crystals, which have low transmittance when 0 V is applied.

In FIG. 3A, of the image signal with two gray levels, a voltage V1 corresponds to a first gray level 301 (black) and a voltage V2 corresponds to a second gray level 302 (white). After the voltage V1 and the voltage V2 are applied in FIG. 3A, the voltages applied to a liquid crystal element are decreased by $\alpha$ ($\alpha$ is a positive number) over time (see an arrow 303 and an arrow 304 in FIG. 3A), so that the gray levels become a gray level 305 corresponding to a voltage V1-$\alpha$ and a gray level 306 corresponding to a voltage V2-$\alpha$. In FIG. 3A, the gray level 305 with the voltage V1-$\alpha$ and the gray level 306 with the voltage V2-$\alpha$ have the same transmittance as the first gray level 301 (black) and the second gray level 302 (white), respectively. In other words, the voltage V2 is preferably converted into a voltage that is increased in advance so that the image quality does not deteriorate because of change in transmittance even if the voltage is decreased over time. In the case where the amount of reduction in voltage over time is small, the application of a large number of increased voltages only leads to an increase in power consumption. Therefore, for an image signal with a small number of gray levels, an increased voltage is preferably applied in this embodiment.

In FIG. 3B, of the image signal with M gray levels, a voltage V1*a* corresponds to a first gray level 307 (black), a voltage V2*a* corresponds to a second gray level 308 (intermediate level), and a voltage VMa corresponds to a Mth gray level 309 (white). As in FIG. 3A, the voltage VMa in FIG. 3B is preferably converted into a voltage that is increased in advance so that the image quality does not deteriorate because of change in transmittance even if the voltage is decreased over time. Note that in the example of FIG. 3B, for the second gray level 308 which is an intermediate level, a voltage increased to such a degree that the gray level is not changed with respect to change in voltage may be applied, or it is possible that voltages for intermediate levels are not increased.

As for an image signal with a small number of gray levels, such as the image signal with two gray levels in FIG. 3A, change in gray level due to reduction in voltage over time is small. For that reason, by application of a large number of increased voltages, change in gray level due to reduction in voltage over time can be reduced, and deterioration of image quality can be reduced. On the other hand, as for an image signal with a large number of gray levels, such as the image signal with M gray levels in FIG. 3B, change in gray level due to reduction in voltage over time is large. For that reason, it is preferable to reduce deterioration of image quality by increase in refresh rate, rather than by application of a large number of increased voltages. Note that even for an image signal with a large number of gray levels, such as the image signal with M gray levels in FIG. 3B, a voltage expressing the Mth gray level (white) can be maintained by application of a voltage increased in consideration of change in gray level due to reduction in voltage over time, and the reduction in contrast ratio of images can be suppressed. Note that in order to reduce power consumption, voltage is preferably increased particularly for an image signal with a small number of gray levels, rather than for an image signal with a large number of gray levels.

With the above-described structure in which the absolute value of the highest voltage among voltages applied for controlling alignment of liquid crystals is made larger in the still image display period 105 than in the moving image display period 104, the reduction in contrast ratio of images can be further suppressed. Specifically, for normally black mode liquid crystals, the absolute value of a voltage applied to a liquid crystal element for expressing white in an image corresponding to an image signal in the still image display period 105 is made larger than that in the moving image display period 104. Since the refresh rate in the still image display period 105 is lower than that in the moving image display period 104, change in gray level due to reduction in voltage over time is large. For that reason, by increasing the absolute value of the highest voltage among voltages applied for controlling alignment of liquid crystals in the still image display period 105, the reduction in contrast ratio of images can be suppressed. Note that even if the absolute value of the highest voltage among voltages applied for controlling alignment of liquid crystals is increased in the moving image display period 104, change in gray level due to reduction in voltage over time does not have such an influence that the reduction in contrast ratio of images is suppressed. Therefore, it is rather preferable to decrease the absolute value of the highest voltage among voltages applied for controlling alignment of liquid crystals, because power consumption can be reduced.

Figure 4A:
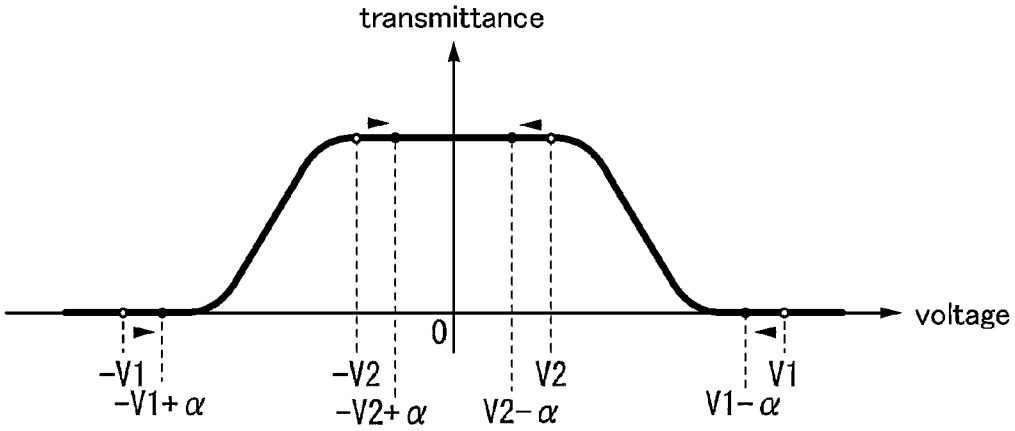
FIGS. 4A and 4B each illustrate a liquid crystal display device according to one embodiment of the present invention.
Figure 4B:
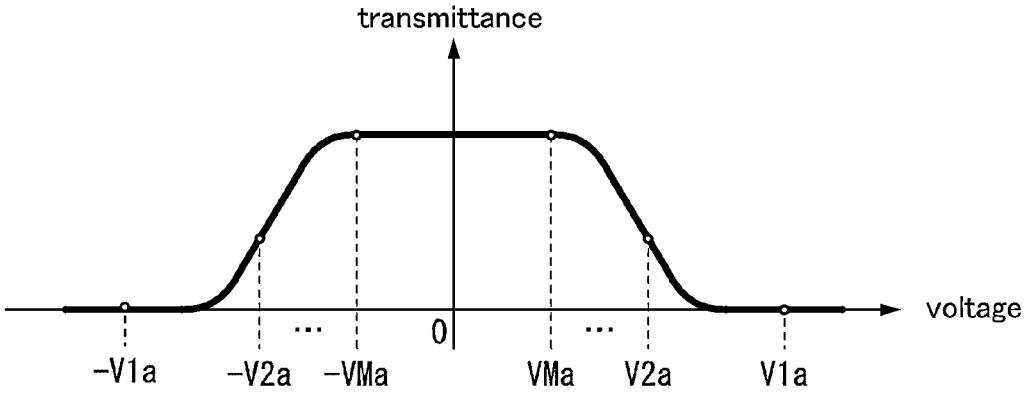

As in FIGS. 2A and 2B and FIGS. 3A and 3B, FIG. 4A shows the relation between voltage of an image signal with two gray levels and transmittance of liquid crystals and FIG. 4B shows the relation between voltage of an image signal with M gray levels and transmittance of liquid crystals. FIGS. 4A and 4B show the transmittance of normally white mode liquid crystals, which have high transmittance when 0 V is applied, and show the relation between transmittance and voltage at the time of performing inversion driving. For inversion driving, the polarity of an image signal is inverted depending on dot inversion driving, source line inversion driving, gate line inversion driving, frame inversion driving, or the like as appropriate and the inverted voltage is applied to a liquid crystal element.

Figure 5A:
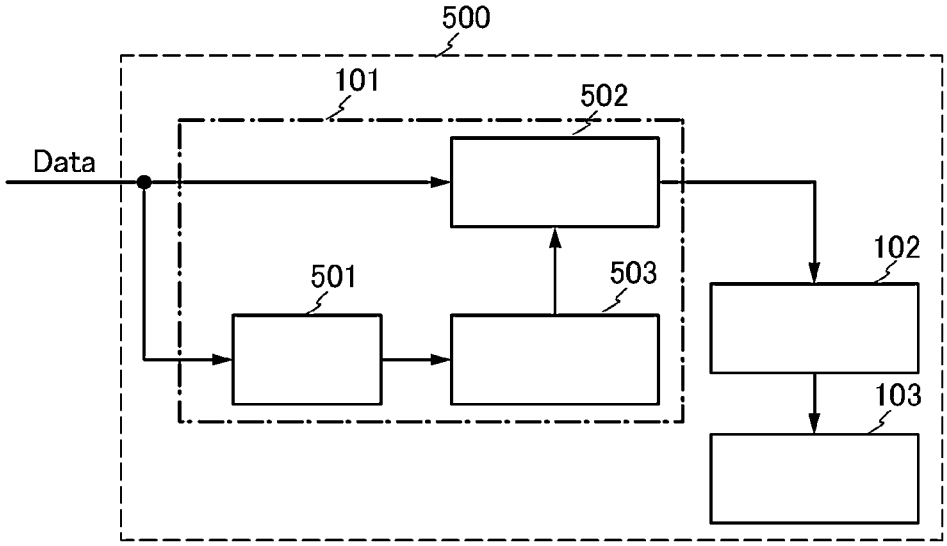
FIGS. 5A and 5B each illustrate a liquid crystal display device according to one embodiment of the present invention.

A liquid crystal display device 500 in the block diagram illustrated in FIG. 5A includes a timing controller (also referred to as a timing control circuit) 101, a driver circuit 102, and a display portion 103 as in FIG. 1A. The timing controller 101 in this embodiment converts the absolute value of the highest voltage among voltages applied for controlling alignment of liquid crystals, in accordance with the number of gray levels of an image displayed with an image signal especially in a still image display period. The block diagram in FIG. 5A shows the detailed structure of the timing controller 101 for making voltages vary in accordance with image signals with different gray level numbers.

The timing controller 101 illustrated in FIG. 5A includes an analysis unit 501, a panel controller (also referred to as a display control circuit) 502, and an image signal correction control unit 503. The analysis unit 501 in FIG. 5A may be a circuit for detecting the gray level of an inputted image signal Data, or may analyze bit values of pixels. The image signal correction control unit 503 controls the panel controller 502 for varying voltages of a first image signal and a second image signal with different gray level numbers, on the basis of the gray level of the image signal Data detected by the analysis unit 501 or the analysis result of bit values of pixels.

Figure 5B:
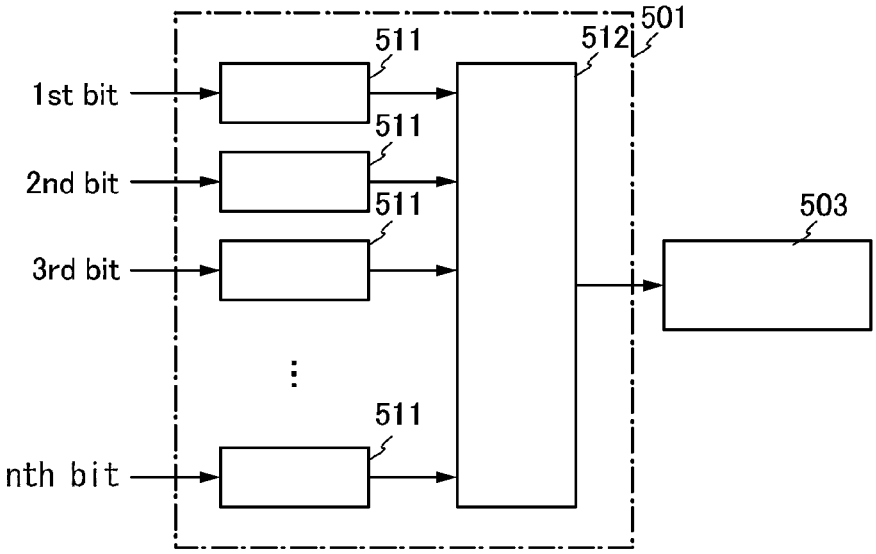

FIG. 5B illustrates the structure of the analysis unit 501. The analysis unit 501 in FIG. 5B includes a plurality of counter circuits 511 and a determination unit 512. The counter circuit 511 is provided per bit and performs counting by switching a count value in accordance with the bit value of an inputted image signal Data. Specifically, for example, when a count value in at least one of the plurality of counter circuits 511 is switched, it is found that bit values of all the pixels are not the same. The determination unit 512 determines whether the count value is switched in the plurality of counter circuits 511, and outputs the result to the image signal correction control unit 503.

Figure 6:
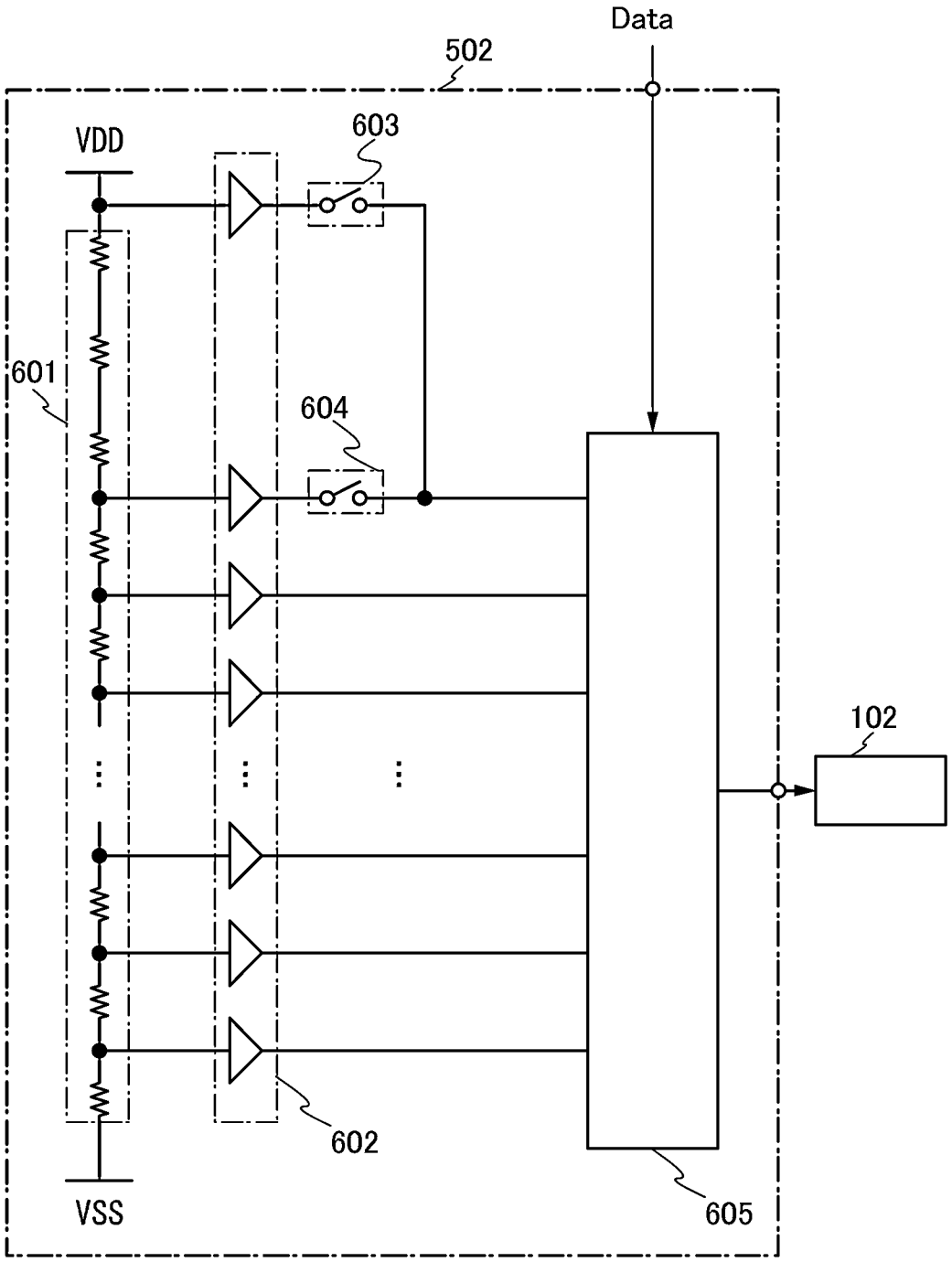
FIG. 6 illustrates a liquid crystal display device according to one embodiment of the present invention.

As illustrated in FIG. 6, the panel controller 502 includes a plurality of resistors 601, a buffer circuit 602, a first switch 603, a second switch 604, and a selector circuit (a multiplexer circuit) 605. The circuit in FIG. 6 outputs through the buffer circuit 602 a plurality of voltages obtained by the plurality of resistors 601 connected in series, and converts the voltages for each gray level as a voltage corresponding to the gray level of an image signal. For example, when the first switch 603 and the second switch 604 are switched and operated in accordance with a signal from the image signal correction control unit 503, it is possible to vary the highest voltages of the first image signal and the second image signal corresponding to the number of gray levels or the analysis result of bit values of pixels.

As illustrated in FIG. 6, the first switch 603 and the second switch 604 are switched and operated by the image signal correction control unit 503. Specifically, in FIG. 6, for example, the first switch 603 is off (is non-conducting) and the second switch 604 is on (is conducting) when the image signal has the first gray level number M, while the first switch 603 is on and the second switch 604 is off when the image signal has the second gray level number N. Thus, it is possible to apply a voltage increased to such a degree that the transmittance is not changed.

The selector circuit 605 sequentially selects any one of a plurality voltages obtained by the plurality of resistors 601 connected in series, in accordance with the image signal, and outputs the selected voltage to the driver circuit 102.

As described above, in a period during which a still image is displayed in the structure in this embodiment, deterioration of image quality due to change in gray level because of a reduction in refresh rate can be reduced in advance, and in particular, the reduction in contrast ratio can be reduced. In addition, power consumption can be reduced by a reduction in refresh rate at the time of displaying a still image.

This embodiment can be implemented in appropriate combination with any of the components described in the other embodiments.

Embodiment 2

In this embodiment, a liquid crystal display device of the present invention and an embodiment of a liquid crystal display device with lower power consumption will be described with reference to FIG. 7, FIG. 8, FIGS. 9A and 9B, and FIG. 10.

Figure 7:
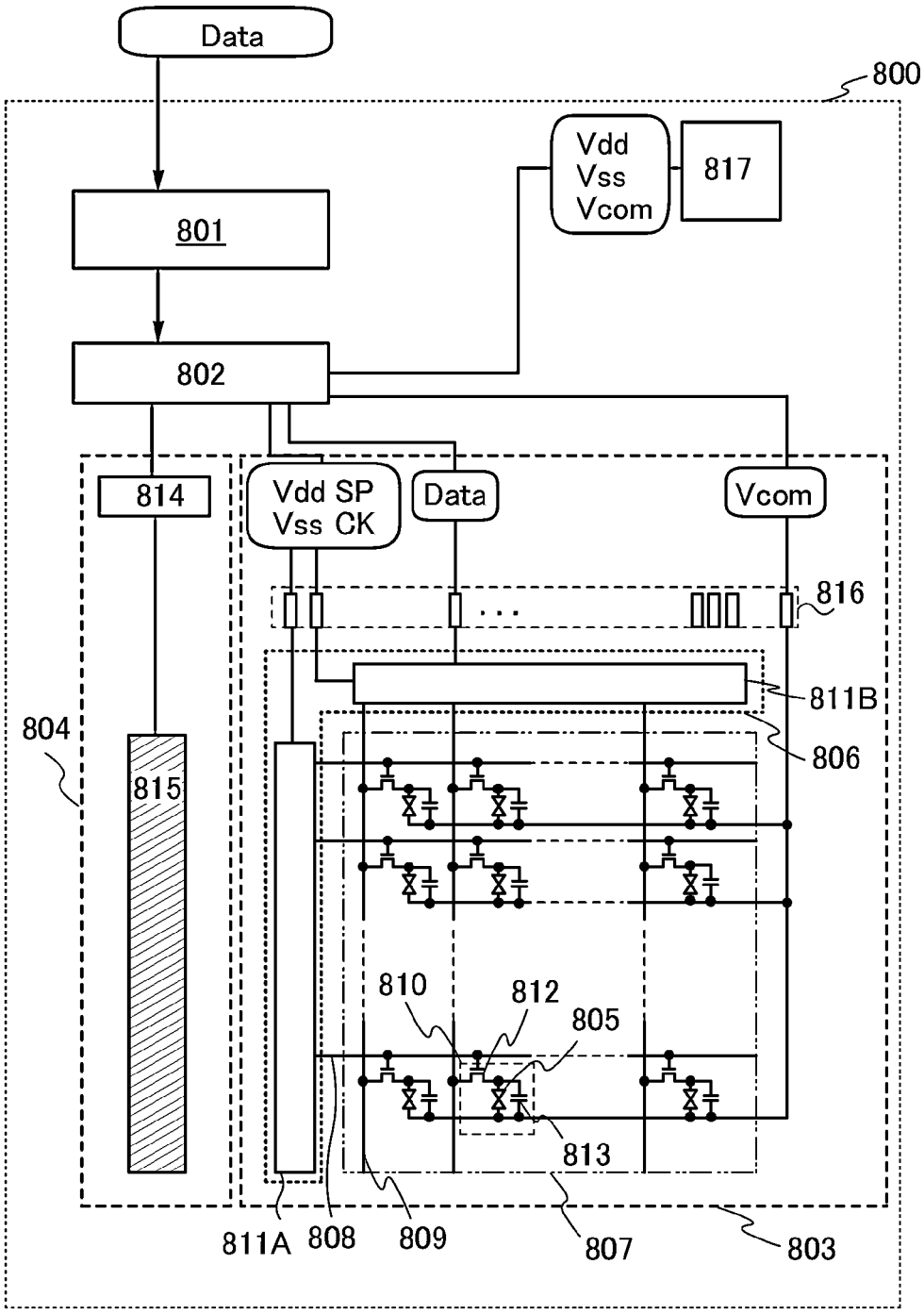
FIG. 7 illustrates a liquid crystal display device according to one embodiment of the present invention.

The block diagram in FIG. 7 illustrates components in a liquid crystal display device 800 described in this embodiment. The liquid crystal display device 800 includes an image processing circuit 801, a timing controller 802, and a display panel 803. In the case where the liquid crystal display device 800 is a transmissive liquid crystal display device or a transflective liquid crystal display device, a backlight unit 804 is provided as a light source.

An image signal (an image signal Data) is supplied to the liquid crystal display device 800 from an external device connected thereto. Power supply potentials (a high power supply potential Vdd, a low power supply potential Vss, and a common potential Vcom) are supplied when a power source 817 in the liquid crystal display device is turned on so that the supply of power starts. Control signals (a start pulse SP and a clock signal CK) are supplied by the timing controller 802.

Note that the high power supply potential Vdd is a potential higher than a reference potential, and the low power supply potential Vss is a potential lower than or equal to the reference potential. Both the high power supply potential Vdd and the low power supply potential Vss are preferably potentials with which a transistor can operate. Note that the high power supply potential Vdd and the low power supply potential Vss are collectively referred to as a power supply voltage in some cases.

The common potential Vcom can be any potential as long as it is a fixed potential serving as a reference with respect to a potential of an image signal supplied to a pixel electrode. For example, the common potential Vcom may be a ground potential.

The image signal Data is inverted in accordance with dot inversion driving, source line inversion driving, gate line inversion driving, frame inversion driving, or the like as appropriate and input to the liquid crystal display device 800. In the case where the image signal is an analog signal, the image signal is converted into a digital signal by an A/D converter or the like and supplied to the liquid crystal display device 800.

In this embodiment, the common potential Vcom which is a fixed potential is applied to one electrode of a liquid crystal element 805 (a counter electrode) and one electrode of a capacitor 813 from the power source 817 through the timing controller 802.

The image processing circuit 801 analyzes, calculates, and/or processes an inputted image signal Data and outputs the processed image signal Data together with a control signal to the timing controller 802.

Specifically, the image processing circuit 801 analyzes an inputted image signal Data and determines whether the signal is for a moving image or a still image, and outputs a control signal including the determination result to the timing controller 802. Moreover, the image processing circuit 801 extracts data for a one-frame still image from the image signal Data including data for a moving image or a still image, and outputs the extracted data together with a control signal denoting that the data is for a still image to the timing controller 802. Furthermore, the image processing circuit 801 outputs the inputted image signal Data together with the above-described control signal to the timing controller 802. Note that the above functions are examples of functions of the image processing circuit 801, and a variety of image processing functions can be applied depending on applications of the display device.

The timing controller 802 is a circuit for supplying the processed image signal Data, a control signal (specifically, a signal for controlling switching of supply and stop of the control signals such as the start pulse SP and the clock signal CK), and the power supply potentials (the high power supply potential Vdd, the low power supply potential Vss, and the common potential Vcom) to the display panel 803, as well as having the functions described in Embodiment 1. Note that the timing controller 802 may also have the function of the image processing circuit 801 when part of the functions of the image processing circuit 801 is shared with the timing controller 802.

Note that an arithmetic operation (e.g., detection of a difference between image signals) is easily performed on an image signal that has been converted into a digital signal; therefore, in the case where an inputted image signal (image signal Data) is an analog signal, an A/D converter or the like is provided in the image processing circuit 801.

In the display panel 803, the liquid crystal element 805 is placed between a pair of substrates (a first substrate and a second substrate). The first substrate is provided with a driver circuit portion 806 and a pixel portion 807. The second substrate is provided with a common connection portion (also referred to as a common contact) and a common electrode (also referred to as a counter electrode). Note that the common connection portion electrically connects the first substrate and the second substrate, and may be provided over the first substrate.

In the pixel portion 807, a plurality of gate lines (scan lines) 808 and a plurality of source lines (signal lines) 809 are provided, and a plurality of pixels 810 are surrounded by the gate lines 808 and the source lines 809 and arranged in matrix. Note that in the display panel shown in this embodiment, the gate lines 808 are extended from a gate line driver circuit 811A and the source lines 809 are extended from a source line driver circuit 811B.

The pixel 810 includes a transistor 812 as a switching element, the capacitor 813 connected to the transistor 812, and the liquid crystal element 805.

The liquid crystal element 805 controls transmission and non-transmission of light by an optical modulation action of liquid crystals. The optical modulation action of liquid crystals is controlled by an electric field applied to the liquid crystals. The direction of an electric field applied to liquid crystals is different depending on a liquid crystal material, a driving method, and the structure of electrodes and can be selected as appropriate. For example, in the case of employing a driving method in which an electric field is applied in the thickness direction of liquid crystals (i.e., in the vertical direction), a pixel electrode and a common electrode are provided on a first substrate and a second substrate, respectively, so that the liquid crystals are sandwiched between the first substrate and the second substrate. Moreover, in the case of employing a driving method in which an electric field is applied in the in-plane direction of the substrate (i.e., a so-called horizontal electric field is applied), a pixel electrode and a common electrode are provided on the same side with respect to the liquid crystals. Further, the pixel electrode and the common electrode may have a variety of opening patterns. In this embodiment, there is no particular limitation on a liquid crystal material, a driving method, and the structure of electrodes as long as an element can control transmission and non-transmission of light by an optical modulation action.

A gate electrode of the transistor 812 is connected to one of the plurality of gate lines 808 provided in the pixel portion 807. One of a source electrode and a drain electrode of the transistor 812 is connected to one of the plurality of source lines 809. The other of the source electrode and the drain electrode of the transistor 812 is connected to the other electrode of the capacitor 813 and the other electrode of the liquid crystal element 805 (the pixel electrode).

As the transistor 812, a transistor with a low off-state current is preferably used. When the transistor 812 is off, electric charge stored in the liquid crystal element 805 connected to the transistor 812 with a low off-state current and electric charge stored in the capacitor 813 are not likely to be leaked through the transistor 812; thus, data written before the transistor 812 is turned off can be stably maintained until a next signal is written. Therefore, the pixel 810 can also be formed without using the capacitor 813 connected to the transistor 812 with a low off-state current.

With such a structure, the capacitor 813 can maintain a voltage applied to the liquid crystal element 805. Moreover, one electrode of the capacitor 813 may be connected to a capacitor line that is additionally provided.

The driver circuit portion 806 includes the gate line driver circuit 811A and the source line driver circuit 811B. Each of the gate line driver circuit 811A and the source line driver circuit 811B is a circuit for driving the pixel portion 807 including a plurality of pixels, and includes a shift register circuit (also referred to as a shift register).

Note that the gate line driver circuit 811A and the source line driver circuit 811B may be formed over the substrate where the pixel portion 807 is formed or a substrate different from the substrate where the display portion 807 is formed.

The driver circuit portion 806 is supplied with the high power supply potential Vdd, the low power supply potential Vss, the start pulse SP, the clock signal CK, and the image signal Data that are controlled by the timing controller 802.

A terminal portion 816 is an input terminal for supplying predetermined signals output from the timing controller 802 (e.g., the high power supply potential Vdd, the low power supply potential Vss, the start pulse SP, the clock signal CK, the image signal Data, and the common potential Vcom) to the driver circuit portion 806.

The liquid crystal display device may include a photometric circuit. The liquid crystal display device including the photometric circuit can detect the brightness of the environment where the liquid crystal display device is placed. As a result, the timing controller 802 to which the photometric circuit is connected can control driving of a light source such as a backlight or a sidelight in accordance with a signal input from the photometric circuit.

The backlight unit 804 includes a backlight control circuit 814 and a backlight 815. The backlight 815 can be selected and combined depending on applications of the liquid crystal display device 800, and a light-emitting diode (LED) or the like can be used. For the backlight 815, a white light-emitting element (e.g., an LED) can be provided, for example. A backlight signal for controlling the backlight and power supply potentials are supplied to the backlight control circuit 814 from the timing controller 802.

Note that color display can be performed with a combination of color filters. Moreover, other optical films (e.g., a polarizing film, a retardation film, and an anti-reflection film) can be used in combination. A light source such as a backlight that is used in a transmissive liquid crystal display device or a transflective liquid crystal display device can be selected and combined depending on applications of the liquid crystal display device 800, and a cold cathode fluorescent lamp, a light-emitting diode (LED), or the like can be used. Moreover, a surface light source may be formed using a plurality of LED light sources or a plurality of electroluminescent (EL) light sources. For the surface light source, three or more kinds of LEDs may be used and an LED emitting white light may be used. Note that a color filter is not always provided in the case where light-emitting diodes of RGB or the like are arranged as a backlight and a successive additive color mixing method (a field sequential method) in which color display is performed by time division is employed.

Next, the states of signals supplied to pixels will be described, using a circuit diagram of the pixels illustrated in FIG. 7 and a timing chart of FIG. 8.

Figure 8:
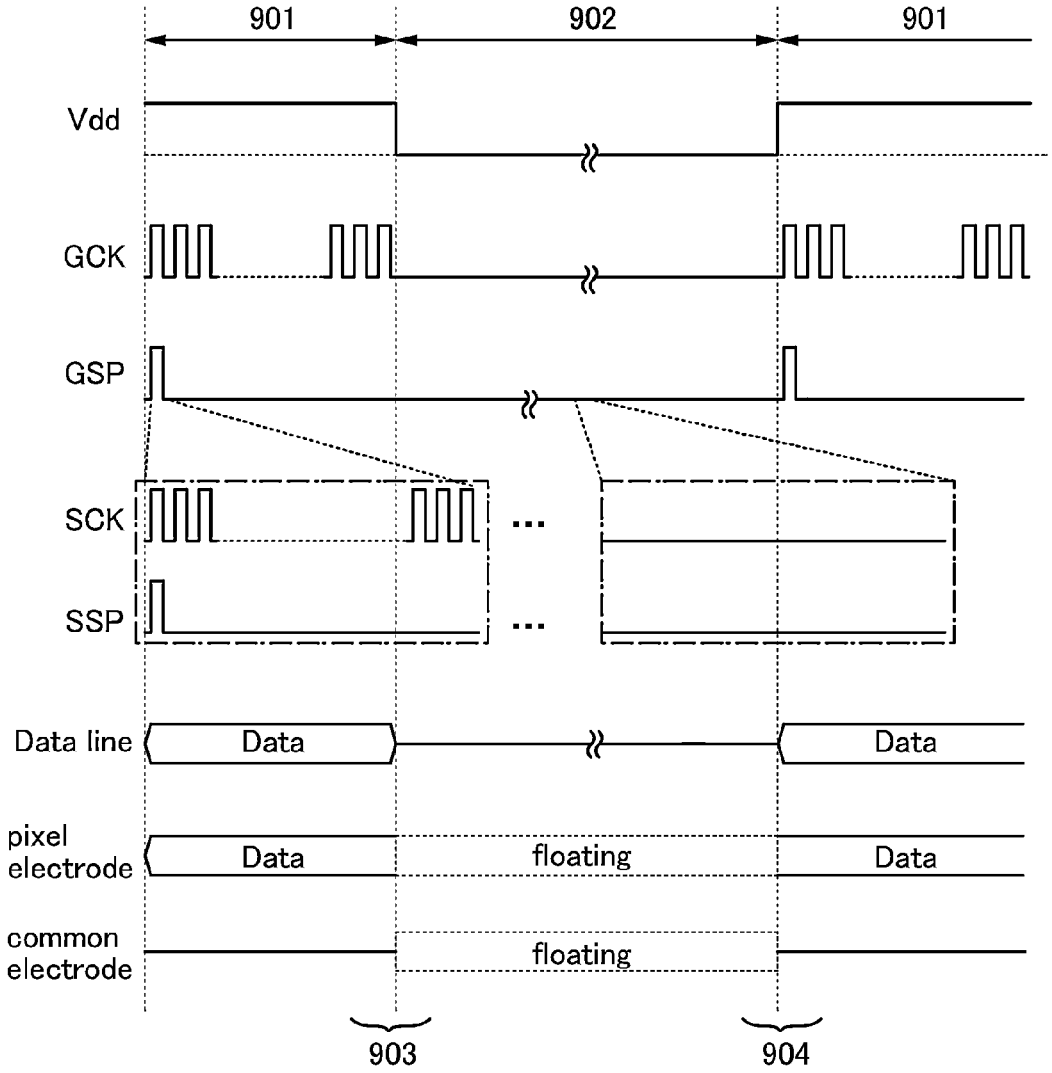
FIG. 8 illustrates a liquid crystal display device according to one embodiment of the present invention.

FIG. 8 shows a clock signal GCK and a start pulse GSP that are supplied to the gate line driver circuit 811A from the timing controller 802, and a clock signal SCK and a start pulse SSP that are supplied to the source line driver circuit 811B from the timing controller 802. Note that FIG. 8 shows a simple square wave as the waveform of the clock signal in order to explain the timing of output of the clock signal.

FIG. 8 also shows a potential of the source line 809 (Data line), a potential of the pixel electrode, and a potential of the common electrode.

In FIG. 8, a period 901 corresponds to a period during which image signals for displaying a moving image are written. In the period 901, the timing controller 802 operates so that the image signals and the common potential are supplied to the pixels in the pixel portion 807 and the common electrode.

A period 902 corresponds to a period during which a still image is displayed. In the period 902, the supply of the image signals to the pixels in the pixel portion 807 is stopped and the supply of the common potential to the common electrode is stopped. Note that in the period 902 in FIG. 8, each signal is supplied so that operation of the driver circuit portion is stopped; depending on the length of the period 902 and the refresh rate, it is preferable to write image signals periodically in order to prevent deterioration of quality of a still image.

With the refresh rate described in Embodiment 1, deterioration of image quality due to change in gray level can be reduced.

First, the timing chart in the period 901 will be described. In the period 901, a clock signal is supplied all the time as the clock signal GCK, and a pulse corresponding to the vertical synchronization frequency is supplied as the start pulse GSP. Moreover, in the period 901, a clock signal is supplied all the time as the clock signal SCK, and a pulse corresponding to one gate selection period is supplied as the start pulse SSP.

Furthermore, the image signal Data is supplied to a pixel in each row through the source line 809, and the potential of the source line 809 is supplied to the pixel electrode depending on the potential of the gate line 808.

On the other hand, the period 902 is a period during which a still image is displayed. Next, the timing chart in the period 902 will be described. In the period 902, the supply of the clock signal GCK, the start pulse GSP, the clock signal SCK, and the start pulse SSP is stopped. Moreover, in the period 902, the image signal Data stops being supplied to the source lines 809. In the period 902 during which the supply of both the clock signal GCK and the start pulse GSP is stopped, the transistor 812 is turned off and the potential of the pixel electrode enters a floating state.

In the period 902, the potentials of the opposite electrodes of the liquid crystal element 805, that is, the pixel electrode and the common electrode can be brought into a floating state, and a still image can be displayed without the supply of another potential.

Further, power consumption can be reduced by stopping the supply of clock signals and start pulses to the gate line driver circuit 811A and the source line driver circuit 811B.

In particular, the use of a transistor with a low off-state current as the transistor 812 can suppress the reduction over time in voltage applied to the opposite electrodes of the liquid crystal element 805.

Figure 9A:
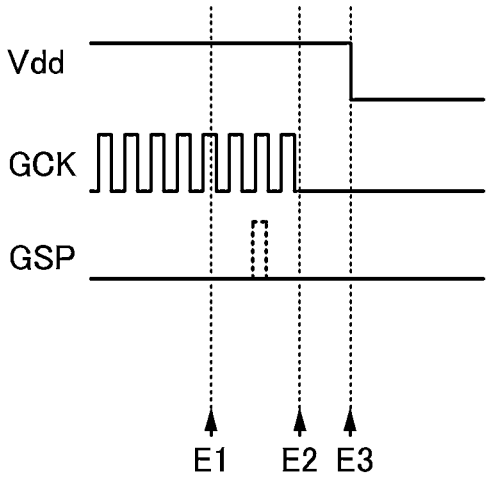
FIGS. 9A and 9B each illustrate a liquid crystal display device according to one embodiment of the present invention.
Figure 9B:
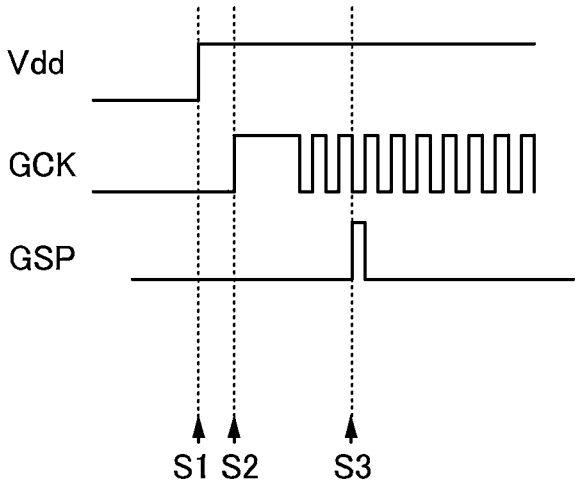

Then, the operation of the display control circuit in a period during which a displayed image is switched from a moving image to a still image (a period 903 in FIG. 8) and a period during which a displayed image is switched from a still image to a moving image (a period 904 in FIG. 8) will be described with reference to FIGS. 9A and 9B. FIGS. 9A and 9B show the high power supply potential Vdd and the potentials of the clock signal (here, GCK) and the start pulse (here, GSP) that are output from the display control circuit.

FIG. 9A illustrates the operation of the display control circuit in the period 903 in which a displayed image is switched from a moving image to a still image. The display control circuit stops supplying the start pulse GSP (E1 in FIG. 9A, a first step). Next, after stopping the supply of the start pulse GSP, the display control circuit stops supplying a plurality of clock signals GCK after pulse output reaches the last stage of the shift register (E2 in FIG. 9A, a second step). Then, the potential of the power supply voltage is changed from the high power supply potential Vdd to the low power supply potential Vss (E3 in FIG. 9A, a third step).

Through the above-described steps, the supply of signals to the driver circuit portion 806 can be stopped without causing malfunction of the driver circuit portion 806. A malfunction caused when a displayed image is switched from a moving image to a still image causes noise, which is held as part of data of a still image. Therefore, in a liquid crystal display device including a display control circuit with few malfunctions, a still image whose quality is not likely to deteriorate because of change in gray level can be displayed.

Note that "stop" of a signal means that the supply of a given potential to a wiring is stopped and the wiring is connected to a wiring to which a predetermined fixed potential is supplied, for example, a wiring to which the low power supply potential Vss is supplied.

Next, FIG. 9B illustrates the operation of the display control circuit in the period 904 in which a displayed image is switched from a still image to a moving image. The display control circuit changes the potential of the power supply voltage from the low power supply potential Vss to the high power supply potential Vdd (S1 in FIG. 9B, a first step). Then, after a high-level potential is supplied as the clock signal GCK, a plurality of clock signals GCK are supplied (S2 in FIG. 9B, a second step). Next, the start pulse GSP is supplied (S3 in FIG. 9B, a third step).

Through the above-described steps, the supply of drive signals to the driver circuit portion 806 can be restarted without causing malfunction of the driver circuit portion 806. The potentials of the wirings are sequentially returned to those at the time of displaying a moving image, so that the driver circuit portion can be driven without causing malfunction.

Figure 10:
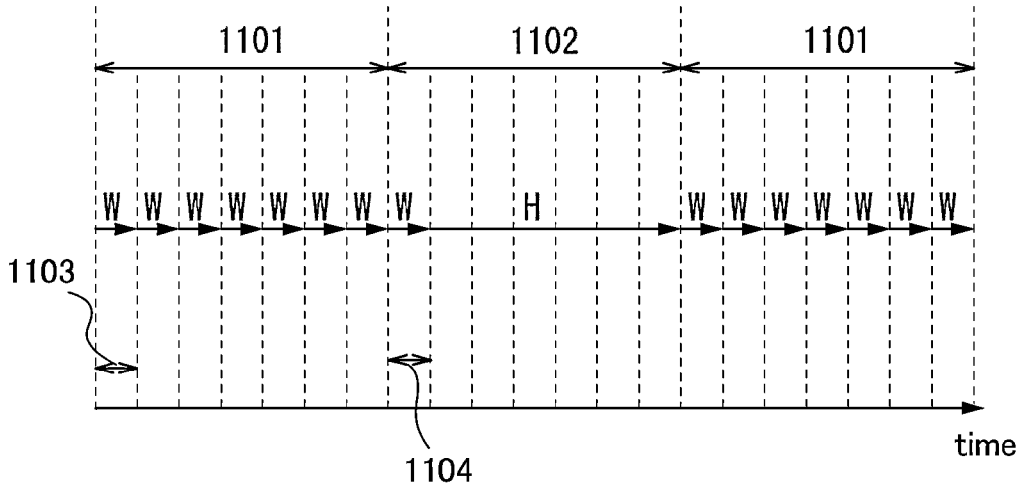
FIG. 10 illustrates a liquid crystal display device according to one embodiment of the present invention.

FIG. 10 schematically illustrates the frequency of writing of image signals per frame period in a period 1101 for displaying a moving image and a period 1102 for displaying a still image. In FIG. 10, "W" indicates a period during which an image signal is written, and "H" indicates a period during which the image signal is held. A period 1103 indicates one frame period in FIG. 10; the period 1103 may be a different period.

In such a manner, in the liquid crystal display device of this embodiment, an image signal for a still image displayed in the period 1102 is written in a period 1104, and the image signal written in the period 1104 is maintained in periods other than the period 1104 in the period 1102.

In the liquid crystal display device described in this embodiment, the frequency of writing of image signals can be reduced in a period during which a still image is displayed. As a result, power consumption in displaying a still image can be reduced.

In the case where a still image is displayed by rewriting the same image plural times, eye strain might occur if switching of images is recognized. In the liquid crystal display device in this embodiment, the frequency of writing of image signals is reduced, which is effective in reducing the level of eye strain to occur.

Specifically, when a transistor with a low off-state current is used in the pixels and as a switching element for the common electrode in the liquid crystal display device in this embodiment, a period (time) during which a voltage can be held in a storage capacitor can be longer. As a result, the frequency of writing of image signals can be reduced, which is significantly effective in reducing power consumption at the time of displaying a still image and reducing the level of eye strain to occur.

Embodiment 3

In this embodiment, an example of a transistor that can be applied to a liquid crystal display device disclosed in this specification will be described.

FIGS. 11A to 11D each illustrate an example of a cross-sectional structure of a transistor.

Figure 11A:
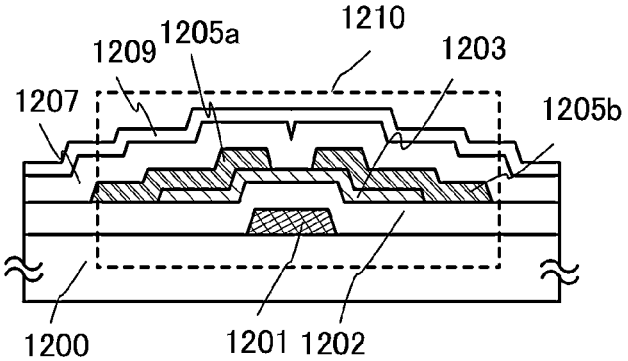
FIGS. 11A to 11D each illustrate a transistor according to one embodiment of the present invention.

A transistor 1210 illustrated in FIG. 11A is a kind of bottom-gate transistor and is also called an inverted staggered transistor.

The transistor 1210 includes, over a substrate 1200 having an insulating surface, a gate electrode layer 1201, a gate insulating layer 1202, a semiconductor layer 1203, a source electrode layer 1205*a*, and a drain electrode layer 1205*b*. An insulating layer 1207 is provided to cover the transistor 1210 and be stacked over the semiconductor layer 1203. A protective insulating layer 1209 is provided over the insulating layer 1207.

Figure 11B:
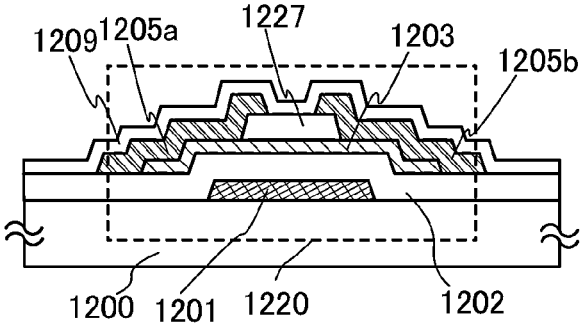

A transistor 1220 illustrated in FIG. 11B has a kind of bottom-gate structure called a channel-protective type (channel-stop type) and is also referred to as an inverted staggered transistor.

The transistor 1220 includes, over a substrate 1200 having an insulating surface, a gate electrode layer 1201, a gate insulating layer 1202, a semiconductor layer 1203, an insulating layer 1227 that is provided over a channel formation region in the semiconductor layer 1203 and functions as a channel protective layer, a source electrode layer 1205*a*, and a drain electrode layer 1205*b*. A protective insulating layer 1209 is provided to cover the transistor 1220.

Figure 11C:
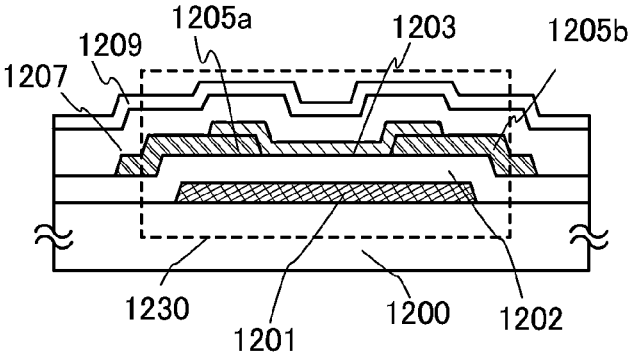

A transistor 1230 illustrated in FIG. 11C is a bottom-gate transistor and includes, over a substrate 1200 which is a substrate having an insulating surface, a gate electrode layer 1201, a gate insulating layer 1202, a source electrode layer 1205*a*, a drain electrode layer 1205*b*, and a semiconductor layer 1203. An insulating layer 1207 is provided to cover the transistor 1230 and be in contact with the semiconductor layer 1203. A protective insulating layer 1209 is provided over the insulating layer 1207.

In the transistor 1230, the gate insulating layer 1202 is provided in contact with the substrate 1200 and the gate electrode layer 1201. The source electrode layer 1205*a* and the drain electrode layer 1205*b* are provided in contact with the gate insulating layer 1202. The semiconductor layer 1203 is provided over the gate insulating layer 1202, the source electrode layer 1205*a*, and the drain electrode layer 1205*b*.

Figure 11D:
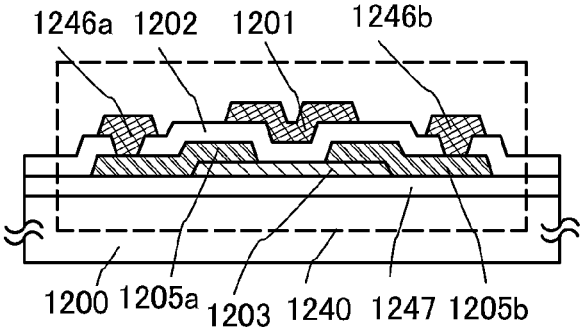

A transistor 1240 illustrated in FIG. 11D is a kind of top-gate transistor. The transistor 1240 includes, over a substrate 1200 having an insulating surface, an insulating layer 1247, a semiconductor layer 1203, a source electrode layer 1205*a* and a drain electrode layer 1205*b*, a gate insulating layer 1202, and a gate electrode layer 1201. A wiring layer 1246*a* and a wiring layer 1246*b* are provided in contact with the source electrode layer 1205*a* and the drain electrode layer 1205*b*, respectively, to be electrically connected to the source electrode layer 1205*a* and the drain electrode layer 1205*b*, respectively.

In this embodiment, the semiconductor layer 1203 comprises an oxide semiconductor.

Examples of oxide semiconductors are an In—Sn—Ga—Zn—O-based metal oxide which is an oxide of four metal elements; an In—Ga—Zn—O-based metal oxide, an In—Sn—Zn—O-based metal oxide, an In—Al—Zn—O-based metal oxide, a Sn—Ga—Zn—O-based metal oxide, an Al—Ga—Zn—O-based metal oxide, and a Sn—Al—Zn—O-based metal oxide which are oxides of three metal elements; an In—Zn—O-based metal oxide, a Sn—Zn—O-based metal oxide, an Al—Zn—O-based metal oxide, a Zn—Mg—O-based metal oxide, a Sn—Mg—O-based metal oxide, and an In—Mg—O-based metal oxide which are oxides of two metal elements; an In—O-based metal oxide, a Sn—O-based metal oxide, and a Zn—O-based metal oxide. Further, the above-described metal oxide semiconductor may contain $SiO_2$. Here, for example, an In—Ga—Zn—O-based metal oxide is an oxide containing at least In, Ga, and Zn and has no particular limitation on the composition ratio of the elements. An In—Ga—Zn—O-based metal oxide may contain an element other than In, Ga, and Zn.

For the oxide semiconductor, a thin film expressed by the chemical formula of $InMO_3(ZnO)_m$ (m>0) can be used. Here, M represents one or more metal elements selected from Ga, Al, Mn, and Co. For example, M can be Ga, Ga and Al, Ga and Mn, or Ga and Co.

Note that in the structure in this embodiment, the oxide semiconductor is an intrinsic (i-type) or substantially intrinsic semiconductor obtained by removal of hydrogen, which is an n-type impurity, from the oxide semiconductor for high purification so that the oxide semiconductor contains an impurity other than the main component as little as possible. In other words, the oxide semiconductor in this embodiment is a purified i-type (intrinsic) semiconductor or a substantially intrinsic semiconductor obtained by removing impurities such as hydrogen and water as much as possible, not by adding an impurity element. In addition, the band gap of the oxide semiconductor is 2 eV or more, preferably 2.5 eV or more, further preferably 3.0 eV or more. Thus, in the oxide semiconductor layer, the generation of carriers due to thermal excitation can be suppressed. Therefore, it is possible to suppress the increase in off-state current due to rise in operation temperature of a transistor in which a channel formation region is formed using the oxide semiconductor.

The number of carriers in the purified oxide semiconductor is very small (close to zero), and the carrier concentration is less than $1\times10^{14}/cm^3$, preferably less than $1\times10^{12}/cm^3$, further preferably less than $1\times10^{11}/cm^3$.

The number of carriers in the oxide semiconductor is so small that the off-state current of the transistor can be reduced. Specifically, the off-state current per channel width of 1 μm of the transistor in which the above-described oxide semiconductor is used for a semiconductor layer can be reduced to 10 aA/μm ($1\times10^{-17}$ A/μm) or lower, further reduced to 1 aA/μm ($1\times10^{-18}$ A/μm) or lower, and still further reduced to 10 zA/μm ($1\times10^{-20}$ A/μm). In other words, in circuit design, the oxide semiconductor can be regarded as an insulator when the transistor is off. Moreover, when the transistor is on, the current supply capability of the oxide semiconductor layer is expected to be higher than that of a semiconductor layer formed of amorphous silicon.

In each of the transistors 1210, 1220, 1230, and 1240 in which the oxide semiconductor is used for the semiconductor layer 1203, the current in an off state (the off-state current) can be low. Thus, the retention time for an electric signal such as image data can be extended, and an interval between writings can be extended. As a result, the refresh rate can be reduced, so that power consumption can be further reduced.

Furthermore, the transistors 1210, 1220, 1230, and 1240 in which the oxide semiconductor is used for the semiconductor layer 1203 can have relatively high field-effect mobility as the ones formed using an amorphous semiconductor; thus, the transistors can operate at high speed. As a result, high functionality and high-speed response of a display device can be realized.

Although there is no particular limitation on a substrate that can be used as the substrate 1200 having an insulating surface, the substrate needs to have heat resistance at least high enough to withstand heat treatment to be performed later. A glass substrate made of barium borosilicate glass, aluminoborosilicate glass, or the like can be used.

In the case where the temperature of heat treatment to be performed later is high, a glass substrate whose strain point is greater than or equal to 730° C. is preferably used. For a glass substrate, a glass material such as aluminosilicate glass, aluminoborosilicate glass, or barium borosilicate glass is used, for example. Note that a glass substrate containing a larger amount of barium oxide (BaO) than boron oxide ($B_2O_3$), which is practical heat-resistant glass, may be used.

Note that a substrate formed of an insulator, such as a ceramic substrate, a quartz substrate, or a sapphire substrate, may be used instead of the glass substrate. Alternatively, crystallized glass or the like may be used. A plastic substrate or the like can be used as appropriate.

In the bottom-gate transistors 1210, 1220, and 1230, an insulating film serving as a base film may be provided between the substrate and the gate electrode layer. The base film has a function of preventing diffusion of an impurity element from the substrate, and can be formed with a single-layer structure or a layered structure including a silicon nitride film, a silicon oxide film, a silicon nitride oxide film, and/or a silicon oxynitride film.

The gate electrode layer 1201 can be formed with a single-layer structure or a layered structure using a metal material such as molybdenum, titanium, chromium, tantalum, tungsten, aluminum, copper, neodymium, or scandium or an alloy material containing any of these materials as its main component.

As a two-layer structure of the gate electrode layer 1201, any of the following layered structures is preferably employed, for example: a two-layer structure in which a molybdenum layer is stacked over an aluminum layer, a two-layer structure in which a molybdenum layer is stacked over a copper layer, a two-layer structure in which a titanium nitride layer or a tantalum nitride layer is stacked over a copper layer, or a two-layer structure in which a titanium nitride layer and a molybdenum layer are stacked. As a three-layer structure of the gate electrode layer 1201, it is preferable to employ a stack of a tungsten layer or a tungsten nitride layer, a layer of an alloy of aluminum and silicon or an alloy of aluminum and titanium, and a titanium nitride layer or a titanium layer. Note that the gate electrode layer can be formed using a light-transmitting conductive film. An example of a material for the light-transmitting conductive film is a light-transmitting conductive oxide.

The gate insulating layer 1202 can be formed with a single-layer structure or a layered structure using any of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer by a plasma CVD method, a sputtering method, or the like.

The gate insulating layer 1202 can have a structure in which a silicon nitride layer and a silicon oxide layer are stacked from the gate electrode layer side. For example, a 100-nm-thick gate insulating layer is formed in such a manner that a silicon nitride layer ($SiN_\gamma$ ($\gamma$>0)) having a thickness of 50 nm to 200 nm is formed as a first gate insulating layer by a sputtering method and then a silicon oxide layer ($SiO_\chi$ ($\chi$>0)) having a thickness of 5 nm to 300 nm is stacked as a second gate insulating layer over the first gate insulating layer. The thickness of the gate insulating layer 1202 may be set as appropriate depending on characteristics needed for a transistor, and may be approximately 350 nm to 1200 nm.

For a conductive film used for the source electrode layer 1205*a* and the drain electrode layer 1205*b*, an element selected from Al, Cr, Cu, Ta, Ti, Mo, and W, an alloy containing any of these elements, or an alloy film containing a combination of any of these elements can be used, for example. A structure may be employed in which a high-melting-point metal layer of Cr, Ta, Ti, Mo, W, or the like is stacked on one or both of a top surface and a bottom surface of a metal layer of Al, Cu, or the like. By using an aluminum material to which an element preventing generation of hillocks and whiskers in an aluminum film, such as Si, Ti, Ta, W, Mo, Cr, Nd, Sc, or Y, is added, heat resistance can be increased.

A conductive film serving as the wiring layers 1246*a* and 1246*b* connected to the source electrode layer 1205*a* and the drain electrode layer 1205*b* can be formed using a material similar to that of the source and drain electrode layers 1205*a* and 1205*b*.

The source electrode layer 1205*a* and the drain electrode layer 1205*b* may have a single-layer structure or a layered structure of two or more layers. For example, the source electrode layer 1205*a* and the drain electrode layer 1205*b* can have a single-layer structure of an aluminum film containing silicon, a two-layer structure in which a titanium film is stacked over an aluminum film, or a three-layer structure in which a titanium film, an aluminum film, and a titanium film are stacked in this order.

The conductive film to be the source electrode layer 1205*a* and the drain electrode layer 1205*b* (including a wiring layer formed using the same layer as the source and drain electrode layers) may be formed using a conductive metal oxide. As the conductive metal oxide, indium oxide ($In_2O_3$), tin oxide ($SnO_2$), zinc oxide (ZnO), an alloy of indium oxide and tin oxide ($In_2O_3$—$SnO_2$, referred to as ITO), an alloy of indium oxide and zinc oxide ($In_2O_3$—ZnO), or any of the metal oxide materials containing silicon or silicon oxide can be used.

As the insulating layers 1207, 1227, and 1247 and the protective insulating layer 1209, an inorganic insulating film such as an oxide insulating layer or a nitride insulating layer is preferably used.

As the insulating layers 1207, 1227, and 1247, an inorganic insulating film such as a silicon oxide film, a silicon oxynitride film, an aluminum oxide film, or an aluminum oxynitride film can be typically used.

As the protective insulating layer 1209, an inorganic insulating film such as a silicon nitride film, an aluminum nitride film, a silicon nitride oxide film, or an aluminum nitride oxide film can be used.

A planarization insulating film may be formed over the protective insulating layer 1209 in order to reduce surface roughness due to the transistor. The planarization insulating film can be formed using a heat-resistant organic material such as polyimide, acrylic, benzocyclobutene, polyamide, or epoxy. Other than such organic materials, it is possible to use a low-dielectric constant material (a low-k material), a siloxane-based resin, PSG (phosphosilicate glass), BPSG (borophosphosilicate glass), or the like. Note that the planarization insulating film may be formed by stacking a plurality of insulating films formed from these materials.

In this embodiment, the use of the transistor in which the oxide semiconductor is used for the semiconductor layer makes it possible to provide a highly functional liquid crystal display device with lower power consumption.

This embodiment can be implemented in appropriate combination with any of the components described in the other embodiments.

Embodiment 4

When transistors are manufactured and used for a pixel portion and a driver circuit, a liquid crystal display device having a display function can be manufactured. Further, part of or the entire driver circuit including transistors can be formed over a substrate where the pixel portion is formed; thus, a system-on-panel can be obtained.

Note that the liquid crystal display device includes any of the following modules in its category: a module provided with a connector, for example, a flexible printed circuit (FPC), a tape automated bonding (TAB) tape, or a tape carrier package (TCP); a module provided with a printed wiring board at the end of a TAB tape or a TCP; and a module where an integrated circuit (IC) is directly mounted on a display element by a chip-on-glass (COG) method.

Figures 2, 12A:
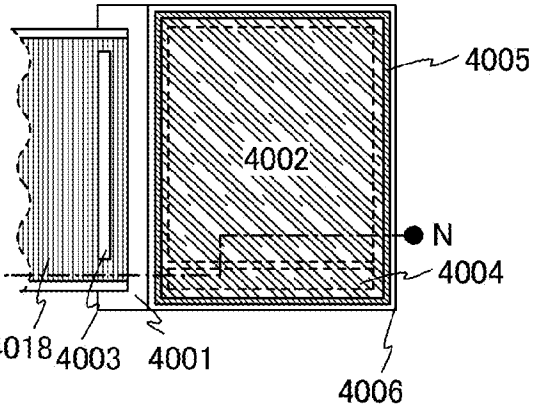
FIGS. 12A-1, 12A-2, and 12B each illustrate a liquid crystal display device according to one embodiment of the present invention.
Figures 1, 12A:
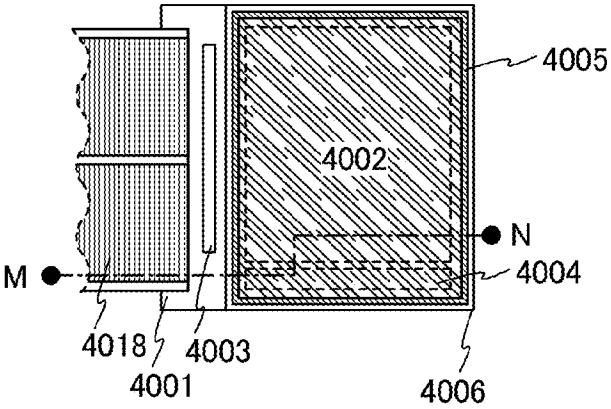
Figure 12B:
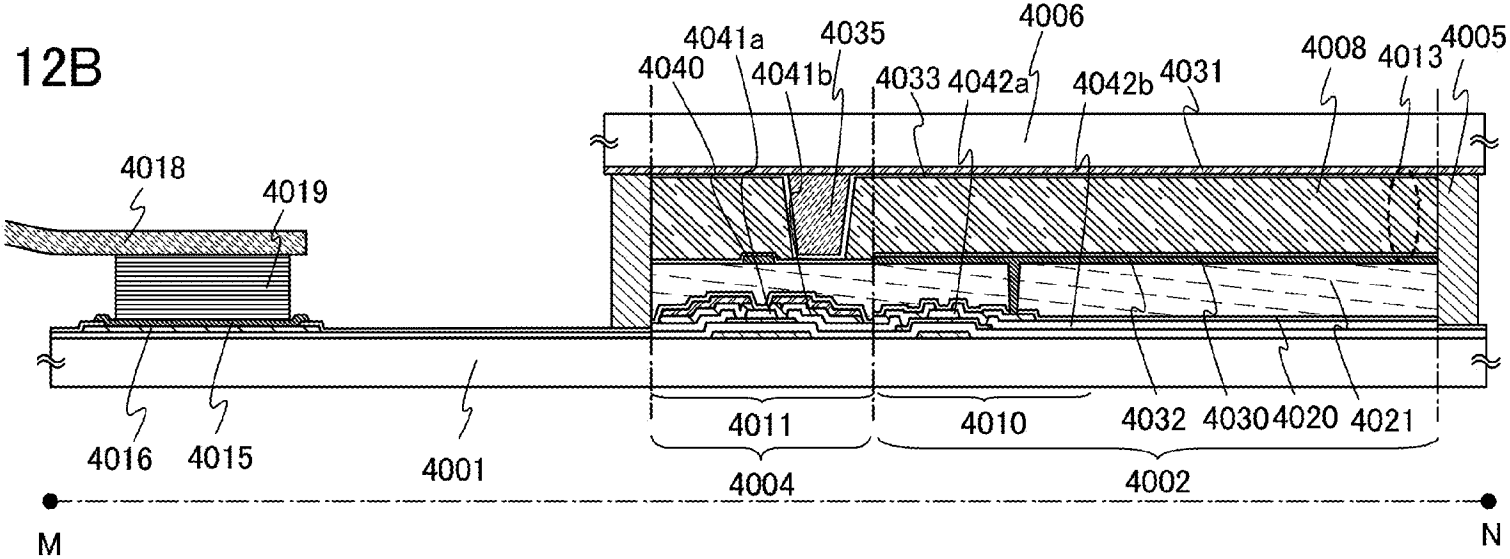

The appearance and a cross section of a liquid crystal display device will be described with reference to FIGS. 12A-1, 12A-2, and 12B. FIGS. 12A-1 and 12A-2 are plan views of panels in which transistors 4010 and 4011 and a liquid crystal element 4013 are sealed between a first substrate 4001 and a second substrate 4006 with a sealant 4005. FIG. 12B is a cross-sectional view along M-N in FIGS. 12A-1 and 12A-2.

The sealant 4005 is provided so as to surround a pixel portion 4002 and a scan line driver circuit 4004 that are provided over the first substrate 4001. The second substrate 4006 is provided over the pixel portion 4002 and the scan line driver circuit 4004. Therefore, the pixel portion 4002 and the scan line driver circuit 4004 are sealed together with a liquid crystal layer 4008, by the first substrate 4001, the sealant 4005, and the second substrate 4006. A signal line driver circuit 4003 that is formed using a single crystal semiconductor film or a polycrystalline semiconductor film over a substrate separately prepared is mounted in a region that is different from the region surrounded by the sealant 4005 over the first substrate 4001.

Note that there is no particular limitation on the connection method of a driver circuit that is separately formed, and a COG method, a wire bonding method, a TAB method, or the like can be used. FIG. 12A-1 illustrates an example where the signal line driver circuit 4003 is mounted by a COG method. FIG. 12A-2 illustrates an example where the signal line driver circuit 4003 is mounted by a TAB method.

The pixel portion 4002 and the scan line driver circuit 4004 provided over the first substrate 4001 include a plurality of transistors. FIG. 12B illustrates the transistor 4010 included in the pixel portion 4002 and the transistor 4011 included in the scan line driver circuit 4004. Insulating layers 4041*a*, 4041*b*, 4042*a*, 4042*b*, 4020, and 4021 are provided over the transistors 4010 and 4011.

A transistor in which an oxide semiconductor is used for a semiconductor layer can be used as the transistors 4010 and 4011. In this embodiment, the transistors 4010 and 4011 are n-channel transistors.

A conductive layer 4040 is provided over part of the insulating layer 4021, which overlaps with a channel formation region using an oxide semiconductor in the transistor 4011 for the driver circuit. The conductive layer 4040 is provided at the position overlapping with the channel formation region using the oxide semiconductor, so that the amount of change in threshold voltage of the transistor 4011 before and after the BT (bias-temperature) test can be reduced. The potential of the conductive layer 4040 may be the same or different from that of a gate electrode layer of the transistor 4011. The conductive layer 4040 can also function as a second gate electrode layer. The potential of the conductive layer 4040 may be GND or 0 V, or the conductive layer 4040 may be in a floating state.

A pixel electrode layer 4030 included in the liquid crystal element 4013 is electrically connected to the transistor 4010. A counter electrode layer 4031 of the liquid crystal element 4013 is provided for the second substrate 4006. A portion where the pixel electrode layer 4030, the counter electrode layer 4031, and the liquid crystal layer 4008 overlap with one another corresponds to the liquid crystal element 4013. Note that the pixel electrode layer 4030 and the counter electrode layer 4031 are provided with an insulating layer 4032 and an insulating layer 4033 functioning as alignment films, respectively, and the liquid crystal layer 4008 is sandwiched between the pixel electrode layer 4030 and the counter electrode layer 4031 with the insulating layers 4032 and 4033 therebetween.

Note that a light-transmitting substrate can be used as the first substrate 4001 and the second substrate 4006; glass, ceramics, or plastics can be used. As plastics, a fiberglass-reinforced plastics (FRP) plate, a polyvinyl fluoride (PVF) film, a polyester film, or an acrylic resin film can be used.

A spacer 4035 is a columnar spacer obtained by selective etching of an insulating film and is provided in order to control the distance (a cell gap) between the pixel electrode layer 4030 and the counter electrode layer 4031. Note that a spherical spacer may be used. The counter electrode layer 4031 is electrically connected to a common potential line formed over the substrate where the transistor 4010 is formed. With use of the common connection portion, the counter electrode layer 4031 and the common potential line can be electrically connected to each other by conductive particles arranged between a pair of substrates. Note that the conductive particles can be included in the sealant 4005.

Alternatively, liquid crystal exhibiting a blue phase for which an alignment film is unnecessary may be used. A blue phase is one of liquid crystal phases, which is generated just before a cholesteric phase changes into an isotropic phase while temperature of cholesteric liquid crystal is increased. Since the blue phase is only generated within a narrow range of temperature, a liquid crystal composition containing a chiral agent at 5 wt % or more so as to improve the temperature range is used for the liquid crystal layer 4008. The liquid crystal composition that includes a liquid crystal exhibiting a blue phase and a chiral agent has a short response time of 1 msec or less, has optical isotropy, which makes the alignment process unneeded, and has a small viewing angle dependence.

Note that this embodiment can also be applied to a transflective liquid crystal display device in addition to a transmissive liquid crystal display device.

This embodiment shows the example of the liquid crystal display device in which a polarizing plate is provided on the outer side of the substrate (on the viewer side) and a coloring layer and an electrode layer used for a display element are provided in this order on the inner side of the substrate; alternatively, a polarizing plate may be provided on the inner side of the substrate. The layered structure of the polarizing plate and the coloring layer is not limited to that in this embodiment and may be set as appropriate depending on materials of the polarizing plate and the coloring layer or conditions of the manufacturing process. Further, a light-blocking film serving as a black matrix may be provided in a portion other than a display portion.

The insulating layer 4041*a* that serves as a channel protective layer and the insulating layer 4041*b* that covers an outer edge portion (including a side surface) of the stack of the semiconductor layers using the oxide semiconductor are formed in the transistor 4011. In a similar manner, the insulating layer 4042*a* that serves as a channel protective layer and the insulating layer 4042*b* that covers an outer edge portion (including a side surface) of the stack of the semiconductor layers using the oxide semiconductor are formed in the transistor 4010.

The insulating layers 4041*b* and 4042*b* that are oxide insulating layers covering the outer edge portion (including the side surface) of the semiconductor layers using the oxide semiconductor can increase the distance between the gate electrode layer and a wiring layer (e.g., a source wiring layer or a capacitor wiring layer) formed over or around the gate electrode layer, so that the parasitic capacitance can be reduced. In order to reduce the surface roughness of the transistors, the transistors are covered with the insulating layer 4021 serving as a planarizing insulating film. Here, as the insulating layers 4041*a*, 4041*b*, 4042*a*, and 4042*b*, a silicon oxide film is formed by a sputtering method, for example.

Moreover, the insulating layer 4020 is formed over the insulating layers 4041*a*, 4041*b*, 4042*a*, and 4042*b*. As the insulating layer 4020, a silicon nitride film is formed by an RF sputtering method, for example.

The insulating layer 4021 is formed as the planarizing insulating film. As the insulating layer 4021, an organic material having heat resistance, such as polyimide, acrylic, benzocyclobutene, polyamide, or epoxy can be used. Other than such organic materials, it is also possible to use a low-dielectric constant material (a low-k material), a siloxane-based resin, PSG (phosphosilicate glass), BPSG (borophosphosilicate glass), or the like. Note that the insulating layer 4021 may be formed by stacking a plurality of insulating films formed of these materials.

In this embodiment, a plurality of transistors in the pixel portion may be surrounded together by a nitride insulating film. It is possible to use a nitride insulating film as the insulating layer 4020 and the gate insulating layer and to provide a region where the insulating layer 4020 is in contact with the gate insulating layer so as to surround at least the periphery of the pixel portion over the active matrix substrate as illustrated in FIGS. 12A-1, 12A-2, and 12B. In this manufacturing process, entry of moisture from the outside can be prevented. Further, even after the device is completed as a liquid crystal display device, entry of moisture from the outside can be prevented in the long term, and the long-term reliability of the device can be improved.

Note that a siloxane-based resin corresponds to a resin including a Si—O—Si bond formed using a siloxane-based material as a starting material. The siloxane-based resin may include an organic group (e.g., an alkyl group or an aryl group) or a fluoro group as a substituent. The organic group may include a fluoro group.

There is no particular limitation on the formation method of the insulating layer 4021, and any of the following methods and tools can be employed, for example, depending on the material: a sputtering method, an SOG method, a spin coating method, a dipping method, a spray coating method, a droplet discharge method (e.g., an ink-jet method, screen printing, and offset printing), a doctor knife, a roll coater, a curtain coater, and a knife coater. The baking step of the insulating layer 4021 also serves as annealing of the semiconductor layer, so that a liquid crystal display device can be efficiently manufactured.

The pixel electrode layer 4030 and the counter electrode layer 4031 can be formed using a light-transmitting conductive material such as indium oxide containing tungsten oxide, indium zinc oxide containing tungsten oxide, indium oxide containing titanium oxide, indium tin oxide containing titanium oxide, indium tin oxide (referred to as ITO), indium zinc oxide, or indium tin oxide to which silicon oxide is added.

Alternatively, the pixel electrode layer 4030 and the counter electrode layer 4031 can be formed using a conductive composition including a conductive high molecule (also referred to as a conductive polymer). The pixel electrode formed using the conductive composition preferably has a sheet resistance of less than or equal to 10000 ohms per square and a transmittance of greater than or equal to 70% at a wavelength of 550 nm. Further, the resistivity of the conductive high molecule included in the conductive composition is preferably less than or equal to 0.1 Ω·cm.

As the conductive high molecule, a so-called π-electron conjugated conductive high molecule can be used. Examples are polyaniline and a derivative thereof, polypyrrole and a derivative thereof, polythiophene and a derivative thereof, and a copolymer of two or more of aniline, pyrrole, and thiophene and a derivative thereof.

A variety of signals and potentials are supplied from an FPC 4018 to the signal line driver circuit 4003 which is formed separately, the scan line driver circuit 4004, or the pixel portion 4002.

A connection terminal electrode 4015 is formed from the same conductive film as the pixel electrode layer 4030 included in the liquid crystal element 4013, and a terminal electrode 4016 is formed from the same conductive film as source and drain electrode layers of the transistors 4010 and 4011.

The connection terminal electrode 4015 is electrically connected to a terminal included in the FPC 4018 via an anisotropic conductive film 4019.

Note that FIGS. 12A-1, 12A-2, and 12B illustrate the example in which the signal line driver circuit 4003 is formed separately and mounted on the first substrate 4001; however, this embodiment is not limited to this structure. The scan line driver circuit may be separately formed and then mounted, or only part of the signal line driver circuit or part of the scan line driver circuit may be separately formed and then mounted.

Figure 13:
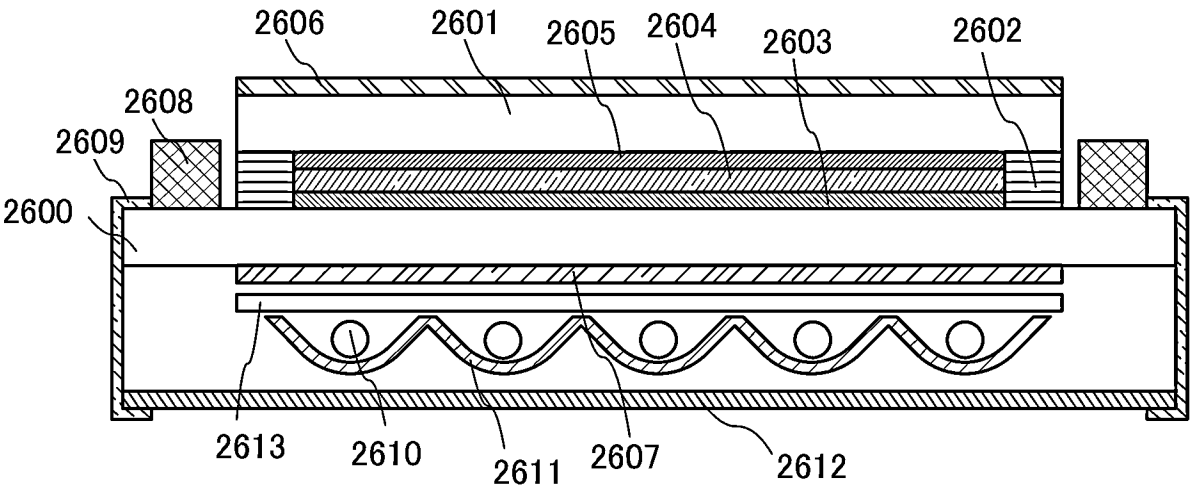
FIG. 13 illustrates a liquid crystal display device according to one embodiment of the present invention.

FIG. 13 illustrates an example of a structure of a liquid crystal display device.

FIG. 13 illustrates an example of a liquid crystal display device. A TFT substrate 2600 and a counter substrate 2601 are fixed to each other with a sealant 2602. A pixel portion 2603 including a TFT and the like, a display element 2604 including a liquid crystal layer, and a coloring layer 2605 are provided between the substrates so that a display region is formed. The coloring layer 2605 is necessary to perform color display. In the RGB system, coloring layers corresponding to colors of red, green, and blue are provided for pixels. A polarizing plate 2606 is provided on the outer side of the counter substrate 2601. A polarizing plate 2607 and a diffusion plate 2613 are provided on the outer side of the TFT substrate 2600. A light source includes a cold cathode tube 2610 and a reflective plate 2611. A circuit board 2612 is connected to a wiring circuit portion 2608 of the TFT substrate 2600 by a flexible wiring board 2609 and includes an external circuit such as a control circuit or a power source circuit. The polarizing plate and the liquid crystal layer may be stacked with a retardation plate therebetween.

For a method for driving the liquid crystal display device, a TN (twisted nematic) mode, an IPS (in-plane-switching) mode, an FFS (fringe field switching) mode, an MVA (multi-domain vertical alignment) mode, a PVA (patterned vertical alignment) mode, an ASM (axially symmetric aligned micro-cell) mode, an OCB (optically compensated birefringence) mode, an FLC (ferroelectric liquid crystal) mode, an AFLC (antiferroelectric liquid crystal) mode, or the like can be used.

Through the above-described process, it is possible to manufacture a liquid crystal display device in which deterioration of image quality due to change in gray level can be reduced in displaying a still image.

This embodiment can be implemented in appropriate combination with any of the components described in the other embodiments.

Embodiment 5

In this embodiment, a structure of a liquid crystal display device obtained by adding a touch panel function to the liquid crystal display device in the above embodiment will be described with reference to FIGS. 14A and 14B.

Figure 14A:
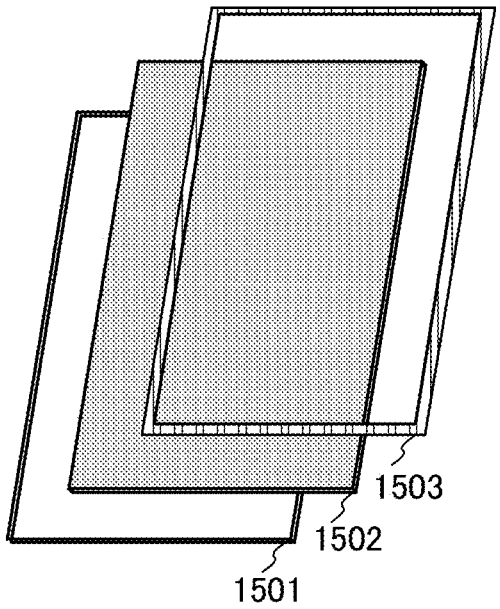
FIGS. 14A and 14B each illustrate a liquid crystal display device according to one embodiment of the present invention.

FIG. 14A is a schematic diagram of a liquid crystal display device in this embodiment. FIG. 14A illustrates a structure where a touch panel unit 1502 overlaps a liquid crystal display panel 1501 which is the liquid crystal display device according to the above embodiment and they are attached together in a housing (a case) 1503. For the touch panel unit 1502, a resistive touchscreen, a surface capacitive touchscreen, a projected capacitive touchscreen, or the like can be used as appropriate.

As illustrated in FIG. 14A, the liquid crystal display panel 1501 and the touch panel unit 1502 are separately fabricated and overlap with each other, so that the cost for manufacturing the liquid crystal display device having a touch panel function can be reduced.

Figure 14B:
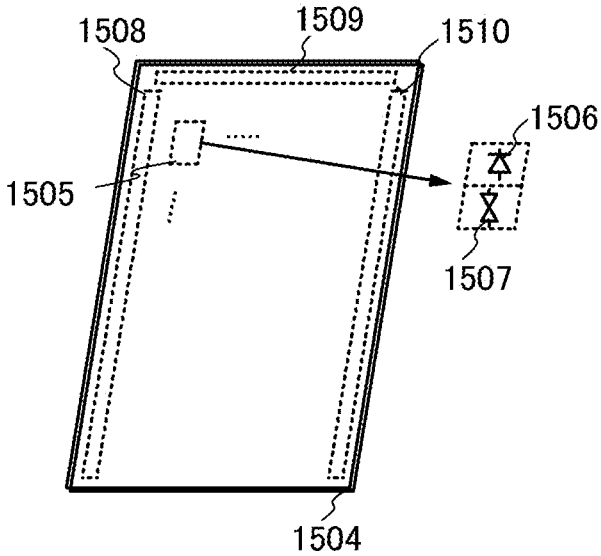

FIG. 14B illustrates a structure of a liquid crystal display device having a touch panel function, which is different from that illustrated in FIG. 14A. A liquid crystal display device 1504 illustrated in FIG. 14B includes a plurality of pixels 1505 each including an optical sensor 1506 and a liquid crystal element 1507. Therefore, unlike in FIG. 14A, the touch panel unit 1502 is not necessarily stacked, so that the liquid crystal display device can be reduced in thickness. When a gate line driver circuit 1508, a signal line driver circuit 1509, and an optical sensor driver circuit 1510 are formed over a substrate where the pixels 1505 are provided, the liquid crystal display device can be reduced in size. Note that the optical sensor 1506 may be formed using amorphous silicon or the like and overlap with a transistor including an oxide semiconductor.

According to this embodiment, a transistor including an oxide semiconductor film is used in a liquid crystal display device having a touch panel function, so that image retention at the time of displaying a still image can be improved. Moreover, it is possible to reduce deterioration of image quality due to change in gray level when a still image is displayed with a reduced refresh rate.

This embodiment can be implemented in appropriate combination with any of the components described in the other embodiments.

Embodiment 6

In this embodiment, an example of an electronic device including the liquid crystal display device described in any of the above-described embodiments will be described.

Figure 15A:
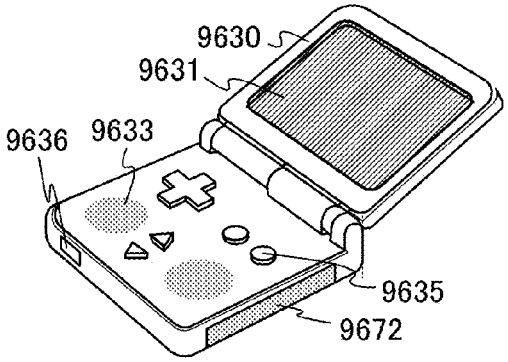
FIGS. 15A to 15D each illustrate an electronic device according to one embodiment of the present invention.

FIG. 15A illustrates a portable game machine that can include a housing 9630, a display portion 9631, a speaker 9633, operation keys 9635, a connection terminal 9636, a recording medium reading portion 9672, and the like. The portable game machine in FIG. 15A can have a function of reading a program or data stored in the recording medium to display it on the display portion, a function of sharing information with another portable game machine by wireless communication, and the like. Note that the functions of the portable game machine in FIG. 15A are not limited to those described above, and the portable game machine can have various functions.

Figure 15B:
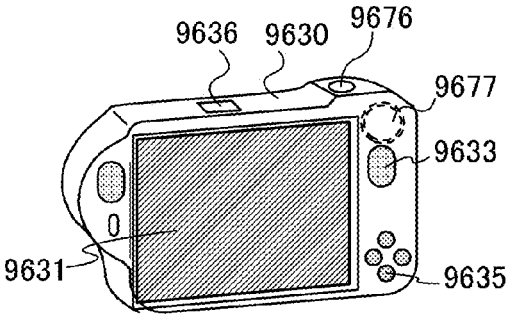

FIG. 15B illustrates a digital camera that can include a housing 9630, a display portion 9631, a speaker 9633, operation keys 9635, a connection terminal 9636, a shutter button 9676, an image receiving portion 9677, and the like. The digital camera in FIG. 15B can have a function of photographing a still image and/or a moving image, a function of automatically or manually correcting the photographed image, a function of obtaining various kinds of information from an antenna, a function of saving the photographed image or the information obtained from the antenna, a function of displaying the photographed image or the information obtained from the antenna on the display portion, and the like. Note that the digital camera in FIG. 15B can have a variety of functions without being limited to the above.

Figure 15C:
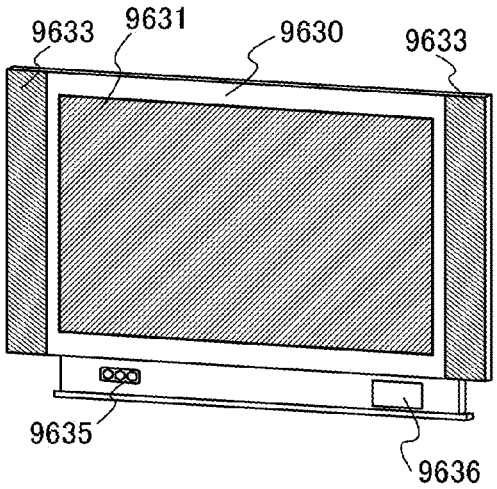

FIG. 15C illustrates a television set that can include a housing 9630, a display portion 9631, speakers 9633, operation key 9635, a connection terminal 9636, and the like. The television set in FIG. 15C has a function of converting an electric wave for television into an image signal, a function of converting an image signal into a signal suitable for display, a function of converting the frame frequency of an image signal, and the like. Note that the television set in FIG. 15C can have a variety of functions without being limited to the above.

Figure 15D:
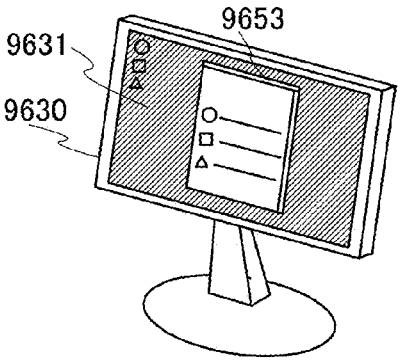

FIG. 15D illustrates a monitor for electronic computers (personal computers) (the monitor is also referred to as a PC monitor) that can include a housing 9630, a display portion 9631, and the like. As an example, in the monitor in FIG. 15D, a window 9653 is displayed on the display portion 9631. Note that FIG. 15D illustrates the window 9653 displayed on the display portion 9631 for explanation; a symbol such as an icon or an image may be displayed. In the monitor for a personal computer, an image signal is rewritten only at the time of inputting in many cases, which is preferable to apply the method for driving a liquid crystal display device in the above-described embodiment. Note that the monitor in FIG. 15D can have various functions without being limited to the above.

Figure 16A:
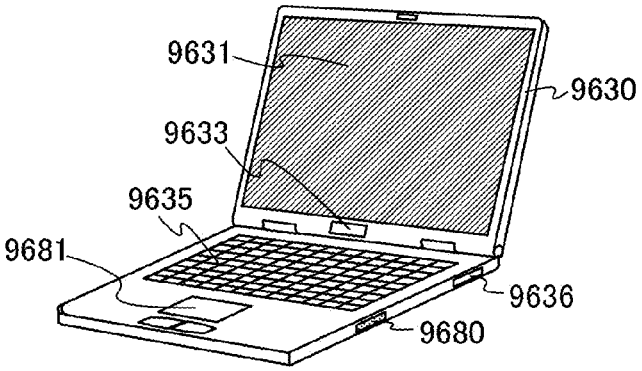
FIGS. 16A to 16D each illustrate an electronic device according to one embodiment of the present invention.

FIG. 16A illustrates a computer that can include a housing 9630, a display portion 9631, a speaker 9633, operation keys 9635, a connection terminal 9636, a pointing device 9681, an external connection port 9680, and the like. The computer in FIG. 16A can have a function of displaying a variety of information (e.g., a still image, a moving image, and a text image) on the display portion, a function of controlling processing by a variety of software (programs), a communication function such as wireless communication or wired communication, a function of being connected to various computer networks with the communication function, a function of transmitting or receiving a variety of data with the communication function, and the like. Note that the computer in FIG. 16A is not limited to having these functions and can have a variety of functions.

Figure 16B:
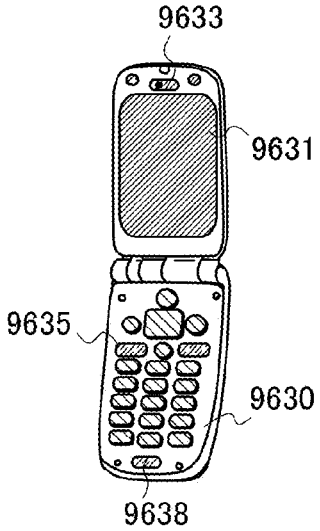

FIG. 16B illustrates a mobile phone that can include a housing 9630, a display portion 9631, a speaker 9633, operation keys 9635, a microphone 9638, and the like. The mobile phone in FIG. 16B can have a function of displaying a variety of information (e.g., a still image, a moving image, and a text image) on the display portion; a function of displaying a calendar, a date, the time, or the like on the display portion; a function of operating or editing the information displayed on the display portion; a function of controlling processing by various kinds of software (programs); and the like. Note that the functions of the mobile phone in FIG. 16B are not limited to those described above, and the mobile phone can have various functions.

Figure 16C:
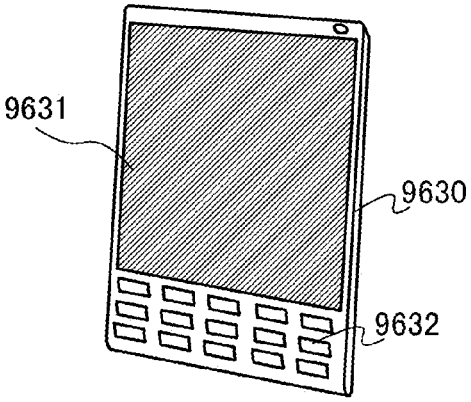
Figure 16D:
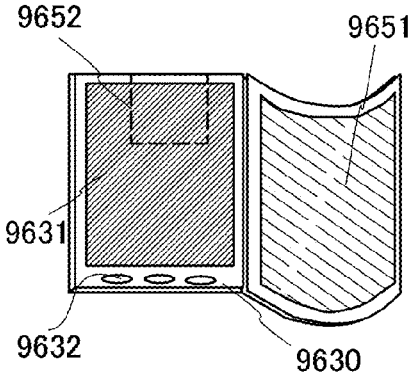

FIG. 16C illustrates an electronic device including electronic paper (also referred to as an eBook or an e-book reader) that can include a housing 9630, a display portion 9631, operation keys 9632, and the like. The e-book reader in FIG. 16C can have a function of displaying a variety of information (e.g., a still image, a moving image, and a text image) on the display portion; a function of displaying a calendar, a date, the time, and the like on the display portion; a function of operating or editing the information displayed on the display portion; a function of controlling processing by various kinds of software (programs); and the like. Note that the e-book reader in FIG. 16C can have a variety of functions without being limited to the above functions. FIG. 16D illustrates another structure of an e-book reader. The e-book reader in FIG. 16D has a structure obtained by adding a solar battery 9651 and a battery 9652 to the e-book reader in FIG. 16C. When a reflective liquid crystal display device is used as the display portion 9631, the e-book reader is expected to be used in a comparatively bright environment, in which case the structure in FIG. 16D is preferable because the solar battery 9651 can efficiently generate power and the battery 9652 can efficiently charge power. Note that when a lithium ion battery is used as the battery 9652, an advantage such as reduction in size can be obtained.

In the electronic device described in this embodiment, it is possible to reduce deterioration of image quality due to change in gray level when a still image is displayed with a reduced refresh rate.

This embodiment can be implemented in appropriate combination with any of the components described in the other embodiments.

This application is based on Japanese Patent Application serial no. 2010-034884 filed with Japan Patent Office on Feb. 19, 2010, the entire contents of which are hereby incorporated by reference.

The invention claimed is:

1. A display device comprising:

a display portion including a display element, and a driver circuit controlling the display portion, wherein the display device has a first period for displaying a moving image and a second period for displaying a still image, and wherein a difference between an absolute value of a lowest voltage among voltages applied to the display element to express black and an absolute value of a lowest voltage among voltages applied to the display element to express white is larger in the second period than in the first period.

2. The display device according to claim 1, further comprising:

a timing controller configured to control the driver circuit, wherein the timing controller is supplied with an image signal for displaying the moving image and an image signal for displaying the still image.

3. The display device according to claim 2, wherein the timing controller switches the first period and the second period by judging the image signal for displaying the moving image and the image signal for displaying the still image.

4. The display device according to claim 1, wherein in the first period, a cycle of one frame period is 1/60 seconds or less.

5. The display device according to claim 1, wherein in the second period, a cycle of one frame period is 1 minute or longer.

6. The display device according to claim 1, wherein the display element includes a transistor configured to control writing of an image signal, and wherein a semiconductor layer of the transistor comprises an oxide semiconductor.

7. A liquid crystal display device comprising the display device according to claim 1.

8. A display device comprising:

a display portion including a display element, and a driver circuit controlling the display portion, wherein the display device has a first period for displaying a moving image and a second period for displaying a still image, wherein a difference between an absolute value of a first voltage applied to the display element to express a first gray level and an absolute value of a second voltage applied to the display element to express a second gray level is larger in the second period than in the first period, and wherein the first voltage is lower than the second voltage.

9. The display device according to claim 8, further comprising:

a timing controller configured to control the driver circuit, wherein the timing controller is supplied with an image signal for displaying the moving image and an image signal for displaying the still image.

10. The display device according to claim 9, wherein the timing controller switches the first period and the second period by judging the image signal for displaying the moving image and the image signal for displaying the still image.

11. The display device according to claim 8, wherein in the first period, a cycle of one frame period is 1/60 seconds or less.

12. The display device according to claim 8, wherein in the second period, a cycle of one frame period is 1 minute or longer.

13. The display device according to claim 8, wherein the display element includes a transistor configured to control writing of an image signal, and wherein a semiconductor layer of the transistor comprises an oxide semiconductor.

14. A liquid crystal display device comprising the display device according to claim 8.

* * * * *